US008563207B2

(12) United States Patent
Minaki et al.

(10) Patent No.: US 8,563,207 B2
(45) Date of Patent: Oct. 22, 2013

(54) TONER BINDER AND TONER COMPOSITION

(75) Inventors: Masashi Minaki, Kyoto (JP); Shinichi Maeda, Kyoto (JP); Mitsumasa Kamura, Kyoto (JP); Shuichi Shinohara, Kyoto (JP); Yuya Iwagoe, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 121 days.

(21) Appl. No.: 13/260,693

(22) PCT Filed: Mar. 31, 2010

(86) PCT No.: PCT/JP2010/055854

§ 371 (c)(1), (2), (4) Date: Dec. 20, 2011

(87) PCT Pub. No.: WO2010/114020

PCT Pub. Date: Oct. 7, 2010

(65) Prior Publication Data

US 2012/0094228 A1 Apr. 19, 2012

(30) Foreign Application Priority Data

| | | |
|---|---|---|
| Mar. 31, 2009 | (JP) | 2009-085414 |
| Aug. 24, 2009 | (JP) | 2009-192788 |
| Oct. 30, 2009 | (JP) | 2009-251116 |

(51) Int. Cl.
*G03G 9/08* (2006.01)

(52) U.S. Cl.
USPC ..... 430/109.4; 430/111.4

(58) Field of Classification Search
USPC ..... 430/109.4, 111.4
See application file for complete search history.

(56) References Cited

U.S. PATENT DOCUMENTS

| | | | |
|---|---|---|---|
| 2006/0154166 | A1 | 7/2006 | Tsunemi et al. |
| 2007/0281235 | A1 | 12/2007 | Ono et al. |
| 2009/0017391 | A1 | 1/2009 | Yamamoto et al. |

FOREIGN PATENT DOCUMENTS

| | | | |
|---|---|---|---|
| EP | 1 698 944 | A1 | 9/2006 |
| JP | 2006-154686 | A | 6/2006 |
| JP | 2007-238954 | A | 9/2007 |

OTHER PUBLICATIONS

Supplementary European Search Report issued in corresponding EP Application No. 10758791.7, dated Aug. 6, 2013.

*Primary Examiner* — Mark A Chapman
(74) *Attorney, Agent, or Firm* — Sughrue Mion, PLLC

(57) ABSTRACT

Disclosed is a toner binder which has high storage stability and can achieve both of good low-temperature fixability and good hot offset resistance (a broadened fixing temperature range). Specifically disclosed is a toner binder comprising, as constituting units, a carboxylic acid component (x) and a polyol component (y), wherein the component (x) comprises two or more kinds of dicarboxylic acids (X1), selected from among aromatic dicarboxylic acids and ester-forming derivatives of the same, in a total amount of 80 mol % or more and a trivalent or higher polycarboxylic acid (x2); the component (y) comprises a polyester resin (P) which is constituted by a polyester resin (A) comprising 80 mol % or more of an aliphatic diol (y1) having 2 to 10 carbon atoms optionally together with a linear polyester resin (B); and the storage modulus at 150° C. [G'150] of resin (A) is 20000 dyn/cm$^2$ or more and the ratio of [G'150] to the storage modulus as 180° C. [G'180] thereof, i.e., [G'150]/[G'180], is 15 of less.

20 Claims, No Drawings

TONER BINDER AND TONER COMPOSITION

TECHNICAL FIELD

The present invention relates to a toner binder and a toner composition.

BACKGROUND ART

With respect to toner binders for electrophotography for use in a thermo-fixing system that is generally used as a fixing system for an image in a copying machine, a printer and the like, characteristics, such as preventing a toner from being fused to adhere to a hot roll even at a high fixing temperature (hot offset resistance), making a toner fixable even at a low fixing temperature (low-temperature fixing property) and storage stability, have been demanded. A toner composition, made from a polyester-based toner binder, that is superior in both of the low-temperature fixing property and hot offset resistance has been known (see Patent Document 1). In recent years, however, demands for the storage stability and both of the low-temperature fixing property and the hot offset resistance (expanding fixing temperature range) have become higher and higher, and the demands have not been satisfied sufficiently.

PRIOR ART DOCUMENTS

Patent Documents

Patent Document 1: JP-A No. 12-75549

SUMMARY OF THE INVENTION

Problems to be Solved by the Invention

An object of the present invention is to provide a toner binder and a toner that are superior in storage stability, as well as in both of low-temperature fixing property and hot offset resistance (expanding fixing temperature range).

Means for Solving the Problems

In order to solve the above-mentioned problems, the present inventors have made extensive examinations, and thus achieved the present invention. The present invention includes the following three inventions.

(I) A toner binder comprising a polyester resin (P) containing at least 10', by weight of a polyester resin (A) that has at least a carboxylic acid component (x) and a polyol component (y) as constituent units, the carboxylic acid component (x) containing 80% or more by mole in total of two or more dicarboxylic acids (x1) selected from the group consisting of aromatic dicarboxylic acids and ester-forming derivatives thereof, and also containing trivalent or more polycarboxylic acid (x2), and the polyol component (y) containing 80% or more by mole of an aliphatic diol (y1) having 2 to 10 carbon atoms, wherein the polyester resin (A) has a storage elastic modulus of 20000 dyn/cm$^2$ or more at 150° C., and a storage elastic modulus represented by a dyn/cm$^2$ unit at 150° C. which is represented by G'150 and a storage elastic modulus represented by a dyn/cm$^2$ unit at 180° C. which is represented by G'180 satisfy the following formula (1):

$$G'150/G'180 \leq 15 \qquad \text{Formula (1)}$$

(II) A toner composition which contains this toner binder and colorant and, if necessary, also contains one or more additives selected from the group consisting of a release agent, a charge controlling agent and a fluidizer.

(III) A method for producing the toner binder in which the polyester resin (A) of the toner binder is a modified polyester resin (A1) containing a urethane group and a urea group, that has a polyisocyanate (i) as well as a polyamine (j) and/or water as constituent units, which includes the step of: producing the modified polyester resin (A1) by using any one of the following [1] to [3]:

[1] a method for producing the modified polyester resin (A1) that includes allowing a solution of a polyester resin (a) containing a hydroxyl group, obtained by polycondensing a carboxylic acid component (x) and a polyol component (y), in an organic solvent (S) to react with a polyisocyanate (i), and then allowing a reaction product having an unreacted isocyanate group to react with a polyamine (j) so that the modified polyester resin (A1) is produced;

[2] a method for producing the modified polyester resin (A1) that includes allowing a polyester resin (a) having a hydroxyl group, obtained by polycondensing a carboxylic acid component (x) and a polyol component (y), in its liquid state to react with a polyisocyanate (i), and then allowing a reaction product containing an unreacted isocyanate group to react with a polyamine (j) so that the modified polyester resin (A1) is produced; and

[3] a method for producing the modified polyester resin (A1) that includes allowing a polyisocyanate (i) and a polyamine (j) to react with each other at an equivalent ratio of from 1.5/1 to 3/1=[isocyanate groups in (i)]/[amino groups in (j)], and then allowing a polyol component (y) containing a modified polyol (y1) obtained by reacting a reaction product containing an unreacted isocyanate group with the polyol component (y) to be polycondensed with a carboxylic component (x) so that the modified polyester resin (A1) is produced.

Effects of the Invention

The present invention makes it possible to provide a toner binder and a toner that are superior in storage stability as well as in both of low-temperature fixing property and hot offset resistance (expanding fixing temperature range).

MODE FOR CARRYING OUT THE INVENTION

Hereinafter, the present invention will be described in detail.

A toner binder of the present invention contains a polyester resin (P) that contains at least 10% by weight of a polyester resin (A) and that is constituted with, if necessary, a linear polyester resin (B).

The polyester resin (A) in the present invention is a polyester resin that has at least a carboxylic acid component (x) and a polyol component (y) as constitutive units, and from the viewpoint of achieving both of low-temperature fixing property and hot offset resistance (expanding fixing temperature range), the polyester resin (A) has the carboxylic acid component (x) which contains 80% or more by mole in the total of two or more dicarboxylic acids (x1) selected from the group consisting of aromatic dicarboxylic acids and ester-forming derivatives thereof, and also contains, at least, trivalent or more polycarboxylic acid (x2), and the polyol component (y) which contains 80% or more by mole of an aliphatic diol (y1) having 2 to 10 carbon atoms, as constitutive units.

The two or more dicarboxylic acids (x1) selected from the group consisting of aromatic dicarboxylic acids and ester-forming derivatives thereof include two or more selected from the group consisting of aromatic dicarboxylic acids having 8 to 36 carbon atoms (phthalic acid, isophthalic acid, terephthalic acid, naphthalene dicarboxylic acid, and the like) and ester-forming derivatives thereof.

The ester-forming derivatives include acid anhydrides, alkyl (with 1 to 24 carbon atoms: methyl, ethyl, butyl, stearyl, or the like, preferably with 1 to 4 carbon atoms) esters, and partial alkyl (the same as described above) esters. The same is true for ester-forming derivatives to be described below.

In the present invention, with respect to the two or more dicarboxylic acids (x1) selected from the group consisting of aromatic dicarboxylic acids and ester-forming derivatives thereof, an aromatic dicarboxylic acid and ester-forming derivatives of the same dicarboxylic acid are defined as one kind.

Among these (x1), from the viewpoints of both of low-temperature fixing property and hot offset resistance, preferably, two or more selected from the following (1) to (3) are preferable.

(1) Terephthalic acid and/or ester-forming derivatives thereof
(2) Isophthalic acid and/or ester-forming derivatives thereof
(3) Phthalic acid and/or ester-forming derivatives thereof.

Preferable combinations are (1) and (2), as well as (1) and (3), and in more preferable combinations, the weight ratio of (1) and (2), that is, (1)/(2), is set to 3/7 to 7/3, and the weight ratio of (1) and (3), that is, (1)/(3), is set to 3/7 to 7/3.

Carboxylic acid components (x) other than dicarboxylic acid (x1) include dicarboxylic acids other than (x1), trivalent or more polycarboxylic acids (x2) and aromatic monocarboxylic acids (x3).

Among the carboxylic acid components (x), dicarboxylic acids other than (x1) include alkane dicarboxylic acids having 4 to 36 carbon atoms (for example, succinic acid, adipic acid and sebacic acid); alicyclic dicarboxylic acids having 6 to 40 carbon atoms (for example, dimer acids (dimerized linolic acid)); alkene dicarboxylic acids having 4 to 36 carbon atoms (for example, alkenyl succinic acids such as dodecenyl succinic acid, maleic acid, fumaric acid, citraconic acid, and mesaconic acid) and ester-forming derivatives thereof; and the like.

Among them, alkane dicarboxylic acids having 4 to 20 carbon atoms, alkene dicarboxylic acids having 4 to 36 carbon atoms, and ester-forming derivatives thereof are preferable, and succinic acid, adipic acid, maleic acid, fumaric acid, and/or ester-forming derivatives thereof are more preferable.

The trivalent or more (preferably, tri- to hexavalent) polycarboxylic acid (x2) includes aromatic carboxylic acids having 9 to 20 carbon atoms (trimellitic acid, pyromellitic acid, and the like), aliphatic (including alicyclic) carboxylic acids having 6 to 36 carbon atoms (hexane tricarboxylic acids, decane tricarboxylic acids, and the like), and ester-forming derivatives thereof.

Among them, trimellitic acid, pyromellitic aid and ester-forming derivatives thereof are preferable.

The aromatic monocarboxylic acid (x3) includes benzoic acids having 7 to 14 carbon atoms and derivatives thereof (derivatives refer to those having a structure in which one or more hydrogen atoms in the aromatic ring of each benzoic acid is substituted by an organic group having 1 to 7 carbon atoms, that is, for example, benzoic acid, 4-phenyl benzoic acid, para-tert-butyl benzoic acid, toluic acid, ortho-benzoyl benzoic acid, and naphthoic acid)) and derivatives of acetic acid having an aromatic substituent having 8 to 14 carbon atoms (derivatives refer to those having a structure in which one or more hydrogen atoms other than those included in a carboxylic group of acetic acid is substituted by an aromatic group having 6 to 12 carbon atoms, that is, for example, diphenyl acetic acid, phenoxy acetic acid, and α-phenoxypropionic acid), and two or more kinds of them may be used in combination. Among them, benzoic acids having 7 to 14 carbon atoms and derivatives thereof are preferable, and benzoic acid is more preferable. In the case where the (x3) is used, a superior anti-blocking property can be obtained when used for a toner.

The amount of the dicarboxylic acid (x1) in the carboxylic acid component (x) is preferably set to 80% by mole or more, preferably from 83 to 98% by mole, and more preferably from 85 to 95% by mole.

Moreover, the amount of the polycarboxylic acid (x2) in the (x) is preferably set to 20% by mole or less, more preferably from 1 to 15% by mole, and particularly preferably from 2 to 12% by mole.

Furthermore, the amount of the aromatic mono-carboxylic acid (x3) in the (x) is preferably set to 10% by mole or less, more preferably to a range from 0.1 to 9.5% by mole, and particularly preferably to a range from 0.5 to 9% by mole.

The aliphatic diol (y1) having 2 to 10 carbon atoms to be used in the polyol component (y) includes alkylene glycols having 2 to 10 carbon atoms (ethylene glycol, 1,2-propylene glycol, 1,3-propylene glycol, 1,4-butane diol, neopentyl glycol, 1,6-hexane diol, 1,9-nonane diol, 1,10-decane diol, and the like); and alkylene ether glycols having 4 to 10 carbon atoms (diethylene glycol, triethylene glycol, dipropylene glycol, and the like).

Among these (y1), from the viewpoint of achieving both of superior low-temperature fixing property and hot offset resistance, unbranched aliphatic diols having a primary hydroxyl group at the terminal of a molecule (ethylene glycol, 1,3-propylene glycol, 1,4-butane diol, 1,6-hexane diol, 1,9-nonane diol, 1,10-decane diol, and the like) are preferable.

From the viewpoint of storage stability, ethylene glycol, 1,3-propylene glycol and 1,4-butane diol are more preferable, and ethylene glycol is particularly preferable.

The polyol component (y) other than the aliphatic diol (y1) includes diols other than the (y1) and trihydric or more polyols.

Among the polyol components (y), the diols other than the (y1) include alkylene glycols having 11 to 36 carbon atoms (1,12-dodecane diol and the like); alkylene ether glycols having 11 to 36 carbon atoms (polyethyleneglycol, polypropylene glycol, polytetramethylene ether glycol, and the like); alicyclic diols having 6 to 36 carbon atoms (1,4-cyclohexane dimethanol, hydrogenated bisphenol A, and the like); (poly) oxyalkylene ethers (wherein alkylene group has 2 to 4 carbon atoms (oxyethylene, oxypropylene, and the like). The same is true for a polyoxyalkylene group to be described later) (having 1 to 30 oxyalkylene units (hereinafter, referred to simply as "AO unit"); and polyoxyalkylene ethers (having 2 to 30 AO units) of dihydric phenols (monocyclic dihydric phenols (for example, hydroquinone), and bisphenols (bisphenol A, bisphenol F, bisphenol S, and the like).

Among them, polyoxyalkylene ethers (having 2 to 30 AO units) of bisphenols are preferable.

The trihydric or more (preferably tri- to octahydric) polyols include: tri- to octahydric or more aliphatic polyhydric alcohols having 3 to 36 carbon atoms (alkane polyols and intramolecular or intermolecular dehydrates, for example, glycerin, trimethylolethane, trimethylolpropane, pentaerythritol, sorbitol, sorbitan, polyglycerin, and dipentaerythritol; sugars and derivatives thereof, for example, saccharose, and methylglucoside); (poly)oxyalkylene ethers (having 1 to 30 AO units) of the above-mentioned aliphatic polyhydric alcohols; (poly)oxyalkylene ethers (having 2 to 30 AO units) of trisphenols (trisphenol PA and the like); and polyoxyalkylene ethers (having 2 to 30 AO units) of novolak resins (phenol novolak, cresol novolak, and the like, average degree of polymerization: 3 to 60).

Among them, tri- to octahydric or more aliphatic polyhydric alcohols, and polyoxyalkylene ethers (having 2 to 30 AO units) of novolak resins are preferable, and polyoxyalkylene ethers (having 2 to 30 AO units) of novolak resins are more preferable.

The amount of the aliphatic diol (yl) in the polyol component (y) (except for that diluted out from the system during a polycondensation reaction, the same is true for the following description) is set to 80% by mole or more, preferably 83% by mole or more, and more preferably 85% by mole or more.

The polyester resin (A) in the present invention can be produced by using the same method as a usual polyester producing method. For example, the production can be carried out by allowing the carboxylic acid component (x) and the polyol component (y) to react with each other under an inert gas (nitrogen gas or the like) atmosphere at a reaction temperature, preferably in a range from 150 to 280° C., more preferably from 170 to 260° C., and particularly preferably from 190 to 240° C. Moreover, from the viewpoint of ensuring the polycondensation reaction, the reaction time is preferably set to 30 minutes or more, in particular, 2 to 40 hours. It is effective to reduce the pressure so as to improve the reaction speed in the final period of the reaction.

The reaction ratio between the polyol component (y) and the carboxylic acid component (x) is preferably set to 2/1 to 1/2, more preferably 1.5/1 to 1/1.3, and particularly preferably 1.3/1 to 1/1.2, as an equivalent ratio [OH]/[COOH] between a hydroxyl group and a carboxylic group.

In this case, an esterification catalyst may be used, if necessary. Examples of the esterification catalyst include: tin-containing catalysts (for example, dibutyl tin oxide), antimony trioxide, titanium-containing catalysts (for example, titanium alkoxide, potassium titanate oxalate, titanium terephthalate, catalysts described in JP-A No. 2006-243715 (titanium dihydroxy bis(triethanol aminate), titanium monohydroxy tris(triethanol aminate), and intramolecular polycondensation products thereof), catalysts described in JP-A No. 2007-11307 (titanium tributoxy terephthalate, titanium triisopropoxy terephthalate, titanium diisopropoxy diterephthalate, and the like)), zirconium-containing catalysts (for example, zirconyl acetate), and zinc acetate. Among them, titanium-containing catalysts are preferable.

The polyester resin (A) to be used in the present invention may be a modified polyester resin (A1) containing a urethane group and a urea group, that further has a polyisocyanate (i) as well as a polyamine (j) and/or water, in addition to the carboxylic acid component (x) and the polyol component (y).

The modified polyester (A1) is preferable from the view point of ensuring a toner fixing temperature range.

The polyisocyanate (i) includes: aromatic polyisocyanates having 6 to 20 carbon atoms (hereinafter excluding carbon atoms in NCO group, the same is true for the following description), aliphatic polyisocyanates having 2 to 18 carbon atoms, alicyclic polyisocyanates having 4 to 15 carbon atoms, aromatic aliphatic polyisocyanates having 8 to 15 carbon atoms, and modified ones of these polyisocyanates (e.g., modified ones containing a urethane group, a carbodiimide group, an allophanate group, a urea group, a biuret group, a urethodione group, a urethoimine group, an isocyanurate group, an oxazolidone group, or the like); and mixtures of two or more thereof.

Specific examples of the aromatic polyisocyanates include, 1,3- or 1,4-phenylene isocyanate, 2,4- and/or 2,6-tolylene diisocyanate (TDI), crude TDI, 2,4'- and/or 4,4'-diphenylmethane diisocyanate (MDI), crude MDI, and 1,5-naphthylene diisocyanate, and 4,4',4"-triphenylmethane triisocyanate.

Specific examples of the aliphatic polyisocyanates include ethylene diisocyanate, tetramethylene diisocyanate, hexamethylenediisocyanate (HDI), dodecamethylene diisocyanate, 1,6,11-undecane triisocyanate, lysine diisocyanate, 2,6-diisocyanatomethyl caproate, and bis(2-isocyanatoethyl) fumarate.

Specific examples of the alicyclic polyisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, and 2,5- and/or 2,6-norbornane diisocyanate.

Specific examples of the aromatic aliphatic polyisocyanates include m- and/or p-xylylene diisocyanate (XDI), and α,α, α', α'-tetramethylxylylene diisocyanate (TMXDI).

Among them, aromatic polyisocyanates having 6 to 15 carbon atoms, aliphatic polyisocyanates having 4 to 12 carbon atoms, and alicyclic polyisocyanates having 4 to 15 carbon atoms are preferable, and TDI, MDI, HDI, hydrogenated MDI, and IPDI are particularly preferable.

As examples of the polyamine (j), aliphatic diamines (C2 to C18) include the following:

[1] aliphatic diamines (C2 to C6 alkylene diamines (ethylenediamine, propylenediamine, trimethylenediamine, tetramethylenediamine, hexamethylenediamine, and the like), polyalkylene (C2 to C6) diamines (diethylenetriamine, iminobispropylamine, bis(hexamethylene)triamine, triethylenetetramine, tetraethylenepentamine, pentaethylenehexamine, and the like));

[2] alkyl (C1 to C4) or hydroxyalkyl (C2 to C4) substituted ones thereof (dialkyl (C1 to C3) aminopropylamine, trimethylhexamethylenediamine, aminoethylethanolamine, 2,5-dimethyl-2,5-hexamethylenediamine, methyl iminobispropyl amine, and the like);

[3] alicyclic- or heterocyclic-ring containing aliphatic diamines (alicyclic diamines (C4 to C15) (1,3-diaminocyclohexane, isophoronediamine, menthenediamine, 4,4'-methylenedicyclohexanediamine (hydrogenated methylene dianiline), and the like), heterocyclic diamines (C4 to C15) (piperazine, N-aminoethylpiperazine, 1,4-diaminoethylpiperazine, 3,9-bis(3-aminopropyl)-2,4,8,10-tetraoxaspiro[5,5] undecane, and the like); and

[4] aromatic ring-containing aliphatic amines (C8 to C15) (xylylenediamine, tetrachloro-p-xylylenediamine, and the like).

The aromatic diamines (C6 to C20) include the following:

[1] unsubstituted aromatic diamines (1,2-, 1,3- and 1,4-phenylenediamine, 2,4'- and 4,4'-diphenylmethanediamine, crude diphenylmethanediamine (polyphenyl polymethylene polyamine), diaminodiphenylsulfone, benzidine, thiodianiline, 2,6-diaminopyridine, m-aminobenzylamine, triphenylmethane-4,4'-4"-triamine, naphthylene diamine, and the like;

[2] aromatic diamines having a nuclear substitutive alkyl group (C1 to C4 alkyl groups such as a methyl group, an ethyl group, a n-propyl and an i-propyl groups, and a butyl group), for example, 2,4- and 2,6-tolylenediamines, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 2,3-dimethyl-1,4-diaminonaphthalene, 4,4'-diamino-3,3'-dimethyldiphenylmethane, and the like), and mixtures of these isomers at various ratios;

[3] aromatic diamines having a nuclear substitutive electron attractive group (halogen groups such as Cl, Br, I, and F groups; alkoxy groups such as methoxy and ethoxy groups; a nitro group, and the like) (methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, and the like); and

[4] aromatic diamines having a secondary amino group (those in which a part of or all of —$NH_2$— of the above-mentioned aromatic diamines [1] to [3] is substituted with —NH—R' (R' is an alkyl group, for example, a lower alkyl group such as a methyl or ethyl group) (4,4'-di(methylamino)diphenylmethane, 1-methyl-2-methylamino-4-aminobenzene, and the like).

In addition to these, specific examples of the polyamine component include: polyamide polyamines (low-molecular-weight polyamide polyamines obtained by condensation of a dicarboxylic acid (such as dimer acid) and an excessive (not less than 2 mol per 1 mol of a carboxylic acid) polyamine (such as the above-mentioned alkylenediamine and polyalkylene polyamine)), and polyether polyamines (hydrides of cyanoethylated polyether polyols (such as polyalkylene glycol)).

With respect to the concentration of urethane and urea groups contained in the modified polyester resin (A1), from the viewpoint of setting both of G'180 and Eta[Tg+40] to be described later to preferable ranges, the total amount of the polyisocyanate (i) and polyamine (j) and water to be reacted with the (i), which are used as raw materials of (A1), relative to the total weight of the (A1) (that is, the total content of the (i) and (j) and water to be reacted with the (i) as the constituent units in the (A1): calculation value) is preferably set to 55% by weight or less, more preferably from 0.1 to 50% by weight, and particularly preferably from 0.3 to 35% by weight.

From the viewpoint of G'180, the mole ratio of the urethane and urea groups introduced is preferably set to urethane group/urea group=10/90 to 95/5, more preferably 45/55 to 90/10.

The above-mentioned mole ratio is determined by the calculation of the ratio of mole number of urethane groups (—NHCOO—) to mole number of urea groups (—NH-CONH—) contained in the (A1), based upon the weights of the polyisocyanate (i), polyamine (j) and water to be reacted with the (i) that have been used upon producing the modified polyester resin (A1).

The method for producing the modified polyester resin (A1) is not particularly limited, and a method including any one of the following three methods is preferable.

Production method [1]: A method that includes allowing a solution of a polyester resin (a) having a hydroxyl group, obtained by polycondensing a carboxylic acid component (x) and a polyol component (y), in an organic solvent (S) to react with a polyisocyanate (i), and then allowing a reaction product containing an unreacted isocyanate to react with a polyamine (j) so that a modified polyester resin (A1) is produced.

Production method [2]: A method that includes allowing a polyester resin (a) having a hydroxyl group, obtained by polycondensing a carboxylic acid component (x) and a polyol component (y), in its liquid state to react with a polyisocyanate (i), and then allowing a reaction product containing an unreacted isocyanate to react with a polyamine (j) so that a modified polyester resin (A1) is produced.

Production method [3]: A method that includes allowing a polyisocyanate (i) and a polyamine (j) to react with each other at an equivalent ratio of from 1.5/1 to 3/1=[isocyanate groups in the (i)]/[amino groups in the (j)], and then allowing a polyol component (y) containing a modified polyol (y1) obtained by reacting a reaction product containing an unreacted isocyanate group with the polyol component (y) to be polycondensed with a carboxylic component (x) so that a modified polyester resin (A1) is produced.

In the production method [1] of the modified polyester resin (A1), upon obtaining the polyester resin (a) having a hydroxyl group, the reaction ratio between the polyol component (y) and the carboxylic acid component (x) is preferably set in a range from 2/1 to 1/1, more preferably from 1.5/1 to 1.01/1, and particularly preferably from 1.3/1 to 1.02/1, in the equivalent ratio, [OH]/[COOH], between the hydroxyl group and the carboxyl group. From the viewpoint of the introduction rate of urethane groups and urea groups, the hydroxyl group value [OHV] (mgKOH/g, the same is true for the following description) is preferably set in a range from 0.1 to 100, and more preferably from 0.2 to 90.

As the polyol component (y) and the carboxylic acid component (x), the aforementioned components can be used, without being particularly limited. If necessary, the aforementioned esterification catalyst may be used.

Although the organic solvent (S) is not particularly limited as long as it can dissolve the polyester resin (a), from the viewpoint of easiness for removing the solvent, ethyl acetate, butyl acetate, acetone, tetrahydrofuran, methylethyl ketone, toluene and xylene are preferable.

The polyisocyanate (i) is put into a solution prepared by dissolving the polyester resin (a) having a hydroxyl group in the organic solvent (S) so as to be reacted therein. The reaction temperature is preferably set in a range from 50 to 120° C. from the viewpoints of the reaction speed and suppression of allophanation, and the reaction time is preferably set to 48 hours or less from the viewpoint of productivity. The reaction ratio between the polyester resin (a) and polyisocyanate (i) is preferably set in a range from 1/1.5 to 1/10, more preferably from 1/1.6 to 1/3, and particularly preferably from 1/1.8 to 1/2.6 in the equivalent ratio [OH]/[NCO] between the hydroxyl group and the isocyanate group.

Next, the reaction product between the polyester resin (a) and the polyisocyanate (i) is allowed to react with the polyamine (j) so that a modified polyester resin (A1) is produced. The reaction temperature is preferably set in a range from 10 to 100° C. from the viewpoints of the reaction speed and suppression of biuretization, and the reaction time is preferably set to 48 hours or less from the viewpoint of productivity. The equivalent ratio between the unreacted isocyanate groups of the reaction product of the (a) and (i) and the amino groups of the polyamine (j), [NCO]/[$NH_2$], is preferably set in a range from 0.5/1 to 1.8/1, more preferably from 0.7/1 to 1.3/1, and particularly preferably from 0.75/1 to 1.2/1.

After the reaction, if necessary, a removing step of the organic solvent (S) may be carried out. As the method for removing the organic solvent (S), a generally known method may be used; however, from the viewpoint of productivity, a reduced-pressure desolventizing process is preferable. Prior to removing the organic solvent (S), a linear polyester resin (B), which will be described later, may be mixed and dissolved therein.

In the production method [2], as the polyester resin (a) having a hydroxyl group, the same resin as that of the production method [1] is exemplified. The polyester resin (a) is heated and fused, if necessary, and allowed to react with the polyisocyanate (i) in its liquid state, and further to react with the polyamine (j).

The equivalent ratio between the hydroxyl group of the polyester resin (a) and the isocyanate group of the polyisocyanate (i) and the equivalent ratio between the unreacted isocyanate group in the reaction product of the (a) and (i) and the amino group in the polyamine (j) may be set in the same manner as in the production method [1]. From the viewpoint of cleavage due to allophanation and biuretization, the reaction temperature is preferably set in a range from 150 to 250° C., more preferably from 170 to 230° C., and most preferably from 180 to 220° C.

After the completion of the reaction between the polyester resin (a) and the polyisocyanate (i), the unreacted isocyanate group of the reaction product and the amino group of the polyamine (j) are preferably allowed to react with each other. The reaction time between the (a) and (i) is preferably set to one hour or less, more preferably 30 minutes or less, and most preferably 20 minutes or less. The reaction time between the reaction product of the (a) and (i) and the (j) is preferably set to 30 minutes or less, more preferably 20 minutes or less, and most preferably 15 minutes or less.

The production method [2] is preferably carried out continuously by using a biaxial kneader or a biaxial extrusion kneader. As the biaxial kneader, for example, Labo plasto mill (made by Toyo Seiki Seisaku-Sho Ltd.) is preferable, and as the biaxial extrusion kneader, a KC kneader (Kurimoto, Ltd.), Ikegai PCM-30 (made by Ikegai Corporation) and the like are exemplified.

In the production method [3], first, the polyisocyanate (i) and the polyamine (j) are allowed to react with each other.

At the time of the reaction, from the viewpoints of the introducing rate of the urethane group and the urea group and the storage elastic modulus, the equivalent ratio [NCO]/[$NH_2$] between the isocyanate group in the polyisocyanate (i) and the amino group in the polyamine (j) is preferably set in a range from 1.5/1 to 3/1, more preferably from 1.7/1 to 2.8/1, and further preferably from 1.8/1 to 2.5/1.

At the time of the reaction, from the viewpoints of uniformity in the reaction and reaction temperature management, the reaction may be carried out in the organic solvent (S) and/or the polyol component (y). From the viewpoints of the reaction speed and suppression of biuretization, the reaction temperature is preferably set in a range from 10 to 100° C., and from the viewpoint of productivity, the reaction time is preferably set to 48 hours or less.

Next, the unreacted isocyanate group in the reaction product of the (i) and (j) and the hydroxyl group of the polyol component (y) are allowed to react with each other to produce a modified polyol (y1). The equivalent ratio [OH]/[NCO] between the hydroxyl group and the isocyanate group is preferably set in a range from 1/1 to 1000/1 from the viewpoint of reaction speed. From the viewpoints of the reaction speed and suppression of allophanation, the reaction temperature is preferably set in a range from 50 to 120° C., and from the viewpoint of productivity, the reaction time is preferably set to 48 hours or less.

Additionally, when an excessive amount of the (y) is used, polyol components (y) containing the modified polyol (y1) and polyols other than the (y1) can be obtained.

Moreover, by polycondensing the polyol components (y) containing the modified polyol (y1) and the carboxylic acid component (x), a modified polyester resin (A1) is produced. As the polycondensing conditions, the aforementioned method is preferably carried out.

The content of the modified polyol (y1) in the polyol component (y) is preferably 0.5% by mole or more, and more preferably from 1 to 80% by mole.

The acid value [AV] of the polyester resin (A) is preferably 0 to 100 (mgKOH/g, the same is true for the following description). In the case of the acid value of 100 or less, the electrostatic characteristic when used in toner is not lowered.

In the case of the modified polyester resin (A1), the acid value is more preferably 0 to 80, and particularly preferably 0 to 60. In the case of a polyester resin (A) other than the (A1), from the viewpoint of static electricity quantity, it is more preferably 4 to 80, and particularly preferably 10 to 60.

Moreover, the hydroxyl group value [OHV] of the (A) is preferably 0 to 100, more preferably 0 to 80, and particularly preferably 0 to 50. When the hydroxyl group value is 100 or less, the hot offset resistance when used in toner becomes more favorable.

In the present invention, the acid value and hydroxyl group value of the polyester resin are measured by using a method determined by JIS K0070 (issued in 1992).

Additionally, in the case when there are solvent-insoluble matters caused by a cross-linking process in a sample, those obtained after a melt-kneading process are used as a sample by using the following method.

Kneading device: Labo plasto mill MODEL 4M150 made by Toyo Seiki Seisaku-Sho Ltd.

Kneading conditions: 130° C., 30 minutes at 70 rpm

The peak top molecular weight (hereinafter, described as Mp) of a tetrahydrofuran (THF)-soluble matter of the polyester resin (A) is preferably in a range from 2000 to 20000, more preferably from 3000 to 10500, and particularly preferably from 4000 to 9000, from the viewpoints of both of heat resistant storage stability and low-temperature fixing property of the toner.

In the present invention, the molecular weight (Mp, and number-average molecular weight (hereinafter, described as Mn)) of the polyester resin is measured by gel permeation chromatography (GPC), under the following conditions.

Device (one example): HLC-8120 made by Tosoh Corporation

Column (one example): TSK GEL GMH6 two sets (made by Tosoh Corporation)

Measuring temperature: 40° C.

Sample solution: 0.25% by weight THF (tetrahydrofuran) solution

Solution injection amount: 100 μl

Detection device: Refraction index detector

Standard substance: Standard polystyrene made by Tosoh Corporation (TSK standard POLYSTYRENE) 12 points (molecular weights 500 1050 2800 5970 9100 18100 37900 96400 190000 355000 1090000 2890000)

A molecular weight showing the greatest peak height on the resulting chromatograph is referred to as the peak top molecular weight (Mp). Moreover, the measurement of the molecular weight is carried out through a process in which a polyester resin is dissolved in THF and an insoluble matter is filtered and separated by a glass filter so that the resultant is used as a sample solution.

The glass transition temperature (Tg) of the polyester resin (A) to be used in the present invention is preferably from 30 to 75° C., more preferably from 40 to 72° C., and particularly preferably from 50 to 70° C., from the viewpoints of fixing property, storage stability and durability.

In this case, in the above description and the following description, Tg is measured by using DSC 20 and SSC/580 made by Seiko Denshi K. K. based upon a method (DSC method) defined by ASTM D3418-82.

In the case where the (A) is one other than the modified polyester resin (A1), the softening point [Tm] of the (A) measured by a flow tester is preferably from 120 to 170° C., more preferably from 125 to 160° C., and particularly preferably from 130 to 150° C. Moreover, the Tm of the (A1) is preferably from 120 to 230° C., more preferably from 123 to 225° C., and particularly preferably from 125 to 220° C.

This range makes it possible to provide both of superior hot offset resistance and low-temperature fixing property. In the present invention, the Tm is measured by using the following method.

<Softening Point [Tm]>

By using a Koka-type flow tester (for example, CFT-500D made by Shimadzu Corporation), 1 g of a measuring sample is subjected to a load of 1.96 MPa by a plunger, while being heated at a temperature rising speed of 6° C./min., and extruded through a nozzle having a diameter of 1 mm and a length of 1 mm so that, by drawing a graph showing a relationship between "an amount of the plunger descent (flow value)" and "a temperature", the temperature corresponding to a ½ of the maximum value of the amount of the plunger descent is read from the graph, and this value (the temperature at the time that a half of the measuring sample has flowed out) is defined as a flow softening point [Tm].

Moreover, from the viewpoint of ensuring superior fixing property, the difference [[Tm]−[Tf]] between the softening point [Tm] and a melting initiation point [Tf] of the modified polyester resin (A1) is preferably in a range from 44 to 65° C.

The difference [[Tm]−[Tf]] is more preferably in a range from 46 to 63° C., and particularly preferably from 47 to 60° C.

In an attempt to increase the value of [[Tm]−[Tf]], this attempt can be achieved by increasing the number of cross-linking points, widening the molecular weight distribution, or increasing the urethane group concentration or the urea group concentration.

In the present invention, Tf can be measured by the following method.

<Flow Initiation Temperature [Tf]>

By using a Koka-type flow tester (for example, CFT-500D made by Shimadzu Corporation), 1 g of a measuring sample is subjected to a load of 1.96 MPa by a plunger, while being heated at a temperature rising speed of 6° C./min., and extruded through a nozzle having a diameter of 1 mm and a length of 1 mm so that, by drawing a graph showing a relationship between "an amount of the plunger descent (flow value)" and "a temperature", the temperature at which the plunger decent is started and the flow-out of the resin is started is defined as the flow initiation temperature [Tf].

From the viewpoint of the hot offset resistance when used in toner, the polyester resin (A) to be used in the present invention preferably has a storage elastic modulus (dyn/cm$^2$) at 150° C. (also described as G'150 herein) of 20000 dyn/cm$^2$ or more, and G'150 and the storage elastic modulus (dyn/cm$^2$) at 180° C. (also described as G'180 herein) need to satisfy the following formula (1), preferably the following formula (1'), and more preferably the following formula (1").

Additionally, a polyester resin (P) composed of the polyester resin (A) and the linear polyester resin (B) also preferably has the same storage elastic modulus (G').

$$G'150/G'180 \leq 15 \quad \text{formula (1)}$$

$$G'150/G'180 \leq 14 \quad \text{formula (1')}$$

$$0.1 \leq G'150/G'180 \leq 13 \quad \text{formula (1")}$$

In the case where G'150 and G'180 satisfy the formula (1), it is considered that the viscosity does not become too low in a practical application range even at a high temperature area so that superior hot offset resistance is achieved when the polyester resin (P) is used as a toner.

In an attempt to adjust the storage elastic modulus (G') of the polyester resin (A), for example, in an attempt to decrease G'150/G'180, this attempt can be achieved, for example by increasing the Tm of the polyester resin (A), by increasing the ratio of trivalent or more constituent components so as to increase the number of cross-linking points, by increasing the molecular weight, or by making the Tg higher.

In the present invention, the storage elastic modulus (G') of a polyester resin is measured by using the following viscoelasticity measuring device.

Device: ARES-24A (made by Rheometric Co., Ltd.)
Jig: 25 mm Parallel plate
Frequency: 1 Hz
Distortion rate: 5%
Temperature rising speed: 5° C./min.

Additionally, preferable ranges of Mp and Tg of the polyester resin (P) composed of the polyester resin (A) and the linear polyester resin (B) are the same as those of the polyester resin (A).

From the viewpoint of low-temperature fixing property when used in toner, the viscosity (Pa·s) at Tg+40° C. (referred to also as Eta [Tg+40] herein) of the polyester resin (A) is preferably allowed to satisfy the following formula (2), more preferably the following formula (2'), and most preferably the following formula (2").

The polyester resin (P) is also preferably made to have the same viscosity Eta [Tg+40].

$$Eta[Tg+40] \leq 7\times10^5 \quad \text{formula (2)}$$

$$Eta[Tg+40] \leq 5\times10^5 \quad \text{formula (2')}$$

$$Eta[Tg+40] \leq 4\times10^5 \quad \text{formula (2")}$$

When Eta [Tg+40] satisfies the formula (2), the viscosity at a low-temperature area becomes smaller, making it possible to provide a superior low-temperature fixing property when the polyester resin (P) is used as a toner.

In an attempt to adjust the viscosity Eta of the polyester resin (A), for example, in the case of making Eta [Tg+40] smaller, the Tm of the polyester resin (A) may be lowered, or Mp thereof may be made smaller.

In the present invention, the viscosity Eta of the polyester resin is measured by using the following viscoelasticity measuring device.

Device: ARES-24A (made by Rheometric Co., Ltd.)
Jig: 8 mm Parallel plate
Frequency: 1 Hz
Distortion rate: 5%
Temperature rising speed: 3° C./min.

The polyester resin (P) to be contained in the toner binder of the present invention may contain the liner polyester resin (B), if necessary, in addition to the polyester resin (A). The resin (B) is a polyester resin other than the (A), and is obtained by polycondensing a dicarboxylic acid (for example, the dicarboxylic acid exemplified in the carboxylic acid component (x)) and a diol (for example, the diol exemplified in the polyol component (y)), and this may be also one obtained by modifying the molecular terminal with an acid anhydride in the carboxylic acid component (x). Among them, those in which the molecular terminal is modified by an anhydride of trimellitic acid, phthalic acid, maleic acid, or succinic acid are preferable.

The reaction ratio between the polyol component (y) and the carboxylic acid component (x) is preferably 3/1 to 1/3, more preferably 2.5/1 to 1/2.5, and particularly preferably 2/1 to 1/2, in the equivalent ratio ([OH]/[COOH]) between a hydroxyl group and a carboxylic group.

The polyol component (y) constituting the linear polyester resin (B) preferably contains polyoxy alkylene ether (having 2 to 30 AO units) of bisphenol A and/or alkylene glycol having 2 to 36 carbon atoms. More preferably, this may contain polyoxy alkylene ether (having 2 and/or 3 carbon atoms in the alkylene group and 2 to 8 AO units) of bisphenol A and alkylene glycol having 2 to 12 carbon atoms (in particular, ethylene glycol and 1,2-propylene glycol).

The acid value of the linear polyester resin (B) is preferably from 2 to 100, more preferably from 5 to 80, and particularly preferably from 15 to 60. When the acid value is 2 or more, a superior low-temperature fixing property when used in toner is obtained, and when it is 100 or less, the electrostatic characteristic is not lowered when used in toner.

Moreover, the hydroxyl group value of the (B) is preferably from 10 to 125, and more preferably from 20 to 100. When the hydroxyl group value is 125 or less, superior hot offset resistance is obtained when used in toner.

The Mp of the linear polyester resin (B) is preferably from 1000 to 15000, and more preferably from 1500 to 12000. When the Mp is 1000 or more, a resin strength required for a fixing process can be exerted, and when it is 15000 or less, a superior low-temperature fixing property is obtained when used in toner.

The glass transition temperature [Tg] of the (B) is preferably in a range from 45° C. to 75° C., and more preferably from 50° C. to 70° C. When the Tg is 75° C. or less, the low-temperature fixing property when used in toner can be improved. Moreover, when the Tg is 45° C. or more, the anti-blocking property when used in toner becomes better.

The softening point [Tm] of the (B) measured by a flow tester is preferably set in a range from 70 to 120° C., more preferably from 75 to 110° C., and particularly preferably from 80 to 100° C. Within this range, it becomes possible to provide both of superior hot offset resistance and superior low-temperature fixing property.

The THF-insoluble matter in the linear polyester resin (B) is preferably 5% by weight or less, from the viewpoint of the low-temperature fixing property when used in toner. More preferably, this is 4% by weight or less, and most preferably 3% by weight or less.

The THF-insoluble matter in the present invention is determined by using the following method.

In this method, 50 ml of THF is added to 0.5 g of a sample, and stirred and refluxed for 3 hours. After being cooled, the insoluble matter is filtered by a glass filter, and the resin matter on the glass filter is dried under reduced pressure at 80° C. for 3 hours. Based upon the weight ratio between the weight of the dried resin matter on the glass filter and the weight of the sample, the insoluble matter is calculated.

The specific gravity of each of the polyester resin (A) and the linear polyester resin (B) to be used in the present invention is preferably in a range from 1.1 or more to less than 1.3, and more preferably from 1.15 to 1.29. Within this range, it is possible to provide superior image strength.

The weight ratio [(A)/(B)] between the polyester resin (A) to be used as the polyester resin (P) in the toner binder of the present invention and the linear polyester resin (B) to be used therein, if necessary, is preferably in a range from 10/90 to 100/0, more preferably from 15/85 to 90/10, and particularly preferably from 20/80 to 80/20, from the viewpoint of the balance between the hot offset resistance and low-temperature fixing property when used in toner.

In addition to the polyester resin (P), the toner binder of the present invention may contain resins other than the polyester resin that are normally used as a toner binder, within a range that does not impair its characteristics. Other resins include styrene-based resins having Mn in a range from 1000 to 1,000,000, resins having a structure in which a vinyl resin is grafted to a polyolefin resin, epoxy resins, and polyurethane resins. The other resins may be blended with the (A) and (B), or one portion thereof may be reacted with them. The content of the other resins is preferably 10% by weight or less, and more preferably 5% by weight or less.

In the present invention, the mixing method of the polyester resins (A) and (B) is not particularly limited, and a known method, normally used, may be adopted, and either a powder mixing process or a melt-mixing process may be used. Moreover, the mixing process may be carried out during the toner-forming process.

As a mixing device for use in the melt-mixing process, a batch-type mixing device such as a reaction vessel, and a continuous mixing device may be used. In order to uniformly mix at an appropriate temperature in a short period of time, the continuous mixing device is preferable. The continuous mixing device includes an extruder, a continuous kneader, and a three-roller mill.

The mixing device for use in power mixing includes a Henschel mixer, a Nauta mixer, and a Banbury mixer. A Henschel mixer is preferable.

The toner composition of the present invention contains the toner binder of the present invention, a colorant, and if necessary, at least one or more additives selected from the group consisting of a release agent, a charge controlling agent, and a fluidizer.

As the colorant, all the dyes, pigments, and the like that are used as colorants for use in toner may be used. Specific examples thereof include: carbon black, iron black, Sudan black SM, Fast Yellow G, Benzidine Yellow, Pigment Yellow, Indo Fast Orange, Irgazin Red, Paranitroaniline Red, Toluidine Red, Carmine FB, Pigment Orange R, Lake Red 2G, Rhodamine FB, Rhodamine B Lake, Methylviolet B Lake, Phthalocyanine Blue, Pigment Blue, Brilliant Green, Phthalocyanine Green, Oil Yellow GG, Kayaset YG, Orasole Brown, and Oil Pink OP, and one of them may be used alone, or two or more of them may be used in a mixed manner. Moreover, if necessary, magnetic powder (powder of ferromagnetic metals such as iron, cobalt, and nickel, or compounds such as magnetite, hematite, and ferrite) may be contained therein so as to compatibly function as a colorant.

The content of the colorant is preferably in a range from 1 to 40 parts, and more preferably from 3 to 10 parts, based upon 100 parts of the toner binder of the present invention. Additionally, in the case where the magnetic powder is used, the content thereof is preferably in a range from 20 to 150 parts, and more preferably from 40 to 120 parts. In the above-mentioned and following descriptions, "part" represents "part by weight".

As the release agent, those having a softening point [Tm] from 50 to 170° C. when measured by a flow tester are preferable, and polyolefin waxes, natural waxes, aliphatic alcohols having 30 to 50 carbon atoms, fatty acids having 30 to 50 carbon atoms, and mixtures thereof are exemplified.

The polyolefin wax includes: (co)polymers of olefins (for example, ethylene, propylene, 1-butene, isobutylene, 1-hexene, 1-dodecene, 1-octadecene and mixtures thereof) (including those obtained by (co)polymerization and thermo-degradation type polyolefins), oxides with oxygen and/or ozone of (co)polymers of olefins, maleic acid-modified ones of (co) polymers of olefins (for example, ones which are modified by maleic acid and derivatives thereof (maleic anhydride, monomethylmaleate, monobutylmaleate, dimethylmaleate, and the like)), copolymers of olefins and unsaturated carboxylic acids ((meth) acrylic acid, itaconic acid, maleic anhydride, and the like) and/or unsaturated carboxylic acid alkyl esters ((meth) acrylic acid alkyl (alkyl group having 1 to 18 carbon atoms) esters and maleic acid alkyl (alkyl group having 1 to 18 carbon atoms) esters, and the like), and sasol wax.

The natural waxes include: carnauba waxes, montan waxes, paraffin waxes, and rice waxes. The aliphatic alcohols having 30 to 50 carbon atoms include triacontanol. The fatty acids having 30 to 50 carbon atoms include triacontane carboxylic acid.

Specific examples of the charge controlling agent include Nigrosine dyes, triphenylmethane dyes having a tertiary amine in the side chain, quaternary ammonium salts, polyamine resins, imidazole derivatives, polymers containing quaternary ammonium salts, azo dyes containing metal, copper phthalocyanine dyes, metal salts of salicylic acid, boron complexes of benzilic acid, polymers containing a sulfonic acid group, fluorine-containing polymers, and halogen-substituted aromatic-ring containing polymers.

Specific examples of the fluidizer include: colloidal silica, alumina powder, titanium oxide powder, and calcium carbonate powder.

In the composition ratio of the toner composition of the present invention, based upon the toner weight (in the section, % represents % by weight), the toner binder of the present invention is preferably in a range from 30 to 97%, more preferably from 40 to 90%, and particularly preferably from 45% to 92%; the colorant is preferably in a range from 0.05 to 60%, more preferably from 0.1 to 55%, and particularly preferably from 0.5% to 50%; among additives, the release agent is preferably in a range from 0 to 30%, more preferably from 0.5 to 20%, and particularly preferably from 1% to 10%; the charge controlling agent is preferably in a range from 0 to 20%, more preferably from 0.1 to 10%, and particularly preferably from 0.5% to 7.5%; the fluidizer is preferably in a range from 0 to 10%, more preferably from 0 to 5%, and particularly preferably from 0.1% to 4%, and the total content of the additives is preferably in a range from 3 to 70%, more preferably from 4 to 58%, and particularly preferably from 5% to 50%. When the composition ratio of the toner is maintained in the above-mentioned ranges, a toner having superior electrostatic property can be easily obtained.

The toner composition of the present invention may be obtained by using any of conventionally known methods such as a kneading pulverization method, a phase-change emulsion method, and a polymerization method. For example, in the case where a toner is obtained by using the kneading pulverization method, components other than the fluidizer that constitute the toner are dry-blended, then melt-kneaded, then coarsely pulverized, finally formed into fine particles by using a jet mill pulverizer or the like, further classified to form fine particles preferably in a range from 5 to 20 μm in volume average particle size (D50), and mixed with a fluidizer, so that the toner can be produced. In this case, the particle size (D50) is measured by using a Coulter Counter (for example, trade name: Multisizer III (made by Coulter Inc.)).

Moreover, in the case where the toner is obtained by using the phase-change emulsion method, components other than a fluidizer that constitute the toner are dissolved or dispersed in an organic solvent, emulsified by, for example, adding water thereto, and separated and then classified, so that the toner can be produced. The volume-average particle size of the toner is preferably from 3 to 15 μm.

The toner composition of the present invention is, if necessary, mixed with carrier particles such as iron powders, glass beads, nickel powders, ferrite, magnetite, and ferrite with the surface thereof being coated with a resin (an acrylic resin, a silicone resin, and the like), and used as a developer for an electrostatic latent image. The weight ratio between the toner and the carrier particles is normally from 1/99 to 100/0. Moreover, the toner may also be rubbed with a member such as a charging blade in place of the carrier particles, so as to form an electrostatic latent image.

The toner composition of the present invention is fixed on a supporting material (paper, a polyester film, and the like) by a copying machine, a printer, or the like, and serves as a recording material. The method for fixing it onto the supporting material may include known methods such as a heat roll fixing method and a flash fixing method.

EXAMPLES

Hereinafter, the present invention will be described in more detail based upon examples and comparative examples; however, the present invention is not intended to be limited thereto. Hereinafter, "%" represents "% by weight".

Production Example 1

Synthesis of Polyester Resin (a-1)

Into a reaction vessel equipped with a condenser, a stirrer and a nitrogen introducing tube (reaction vessels used in the following production examples are also equipped therewith) were loaded 460 parts (2.8 moles) of terephthalic acid, 307 parts (1.8 moles) of isophthalic acid, 695 parts (9.1 moles) of 1,2-propylene glycol, and 3 parts of tetrabutoxy titanate serving as a condensing catalyst, and these were allowed to react with one another at 210° C. under a nitrogen gas flow for 5 hours, while generated water and 1,2-propylene glycol being distilled off, and then further allowed to react under a reduced pressure of 5 to 20 mmHg for one hour. Next, to this was added 52 parts (0.27 moles) of trimellitic anhydride, and after being kept at 180° C. for 1 hour, the resulting matter was taken out. The recovered 1,2-propylene glycol was 216 parts (2.8 moles). The resin thus taken out was cooled to room temperature, and then pulverized into a particle. This was defined as a polyester resin (a-1).

As for the polyester resin (a-1), the Tg was 60° C., the Mn was 1700, the OHV was 79, and the AV was 50.

Production Example 2

Synthesis of Polyester Resin (a-2)

Into a reaction vessel were loaded 460 parts (2.8 moles) of terephthalic acid, 307 parts (1.8 moles) of isophthalic acid, 573 parts (9.2 moles) of ethylene glycol, and 3 parts of tetrabutoxy titanate serving as a condensing catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 52 parts (0.27 moles) of trimellitic anhydride, and after being kept at 180° C. for 1 hour, the resulting matter was taken out. The recovered ethylene glycol was 200 parts (3.2 moles). The resin thus taken out was cooled to room temperature, and then pulverized into a particle. This was defined as a polyester resin (a-2).

As for the polyester resin (a-2), the Tg was 59° C., the Mn was 1800, the OHV was 77, and the AV was 49.

Production Example 3

Synthesis of Polyester Resin (a-3)

Into a reaction vessel were loaded 300 parts of terephthalic acid, 300 parts of isophthalic acid, 564 parts of ethylene glycol, 28 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 394 parts. The resulting resin was cooled to room temperature, and then pulverized into a particle. This was defined as a polyester resin (a-3).

As for the polyester resin (a-3), the Tg was 59° C., the Mn was 1800, the OHV was 56, and the AV was 1.

Production Example 4

Synthesis of Polyester Resin (a-4)

Into a reaction vessel were loaded 407 parts of terephthalic acid, 407 parts of isophthalic acid, 570 parts of ethylene glycol, 26 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 411 parts. The resulting resin was cooled to room temperature, and then pulverized into a particle. This was defined as a polyester resin (a-4).

As for the polyester resin (a-4), the Tg was 60° C., the Mn was 2400, the OHV was 40, and the AV was 2.

Production Example 5

Synthesis of Polyester Resin (a-5)

Into a reaction vessel were loaded 286 parts of terephthalic acid, 286 parts of isophthalic acid, 540 parts of ethylene glycol, 57 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 371 parts. The resulting resin was cooled to room temperature, and then pulverized into a particle. This was defined as a polyester resin (a-5).

As for the polyester resin (a-5), the Tg was 56° C., the Mn was 1600, the OHV was 61, and the AV was 1.

Production Example 6

Synthesis of Polyester Resin (a-6)

Into a reaction vessel were loaded 329 parts of terephthalic acid, 493 parts of isophthalic acid, 577 parts of ethylene glycol, 21 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 394 parts. The resulting resin was cooled to room temperature, and then pulverized into a particle. This was defined as a polyester resin (a-6).

As for the polyester resin (a-6), the Tg was 62° C., the Mn was 2900, the OHV was 35, and the AV was 0.

Production Example 7

Synthesis of Polyester Resin (a-7)

Into a reaction vessel were loaded 293 parts of terephthalic acid, 293 parts of isophthalic acid, 550 parts of ethylene glycol, 42 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 385 parts. The resulting resin was cooled to room temperature, and then pulverized into a particle. This was defined as a polyester resin (a-7).

As for the polyester resin (a-7), the Tg was 57° C., the Mn was 1700, the OHV was 58, and the AV was 2.

Production Example 8

Synthesis of Polyester Resin (a-8)

Into a reaction vessel were loaded 354 parts of terephthalic acid, 236 parts of phthalic acid, 554 parts of ethylene glycol, 21 parts of trimellitic anhydride and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 387 parts. The resulting resin was cooled to room temperature, and then pulverized into a particle. This was defined as a polyester resin (a-8).

As for the polyester resin (a-8), the Tg was 58° C., the Mn was 2000, the OHV was 50, and the AV was 1.

Production Example 9

Synthesis of Polyester Resin (A-1)

Into a reaction vessel were loaded 460 parts (2.8 moles) of terephthalic acid, 307 parts (1.8 moles) of isophthalic acid, 573 parts (9.2 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 88 parts (0.46 moles) of trimellitic anhydride, and after being allowed to react under normal pressure for one hour, these were further allowed to react with one another under a reduced pressure of 20 to 40 mmHg so that the resulting matter with a predetermined softening point was taken out. The recovered ethylene glycol was 245 parts (4.0 moles). The resulting resin was cooled to room temperature, and then pulverized into a particle. This was defined as a polyester resin (A-1).

As for the polyester resin (A-1), the Tg was 60° C., the Tm was 140° C., the Mp was 6000, the AV was 27, the OHV was 1, the THF insoluble matter was 3%, and the specific gravity was 1.25.

Production Example 10

Synthesis of Polyester Resin (A-2)

Into a reaction vessel were loaded 463 parts (2.8 moles) of terephthalic acid, 308 parts (1.9 moles) of phthalic acid, 576 parts (9.3 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 88 parts (0.46 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 227 parts (3.7 moles). The resulting resin was cooled to room temperature, and then pulverized into a particle. This was defined as a polyester resin (A-2).

As for the polyester resin (A-2), the Tg was 58° C., the Tm was 142° C., the Mp was 7000, the AV was 26, the OHV was 0.1, the THF insoluble matter was 2%, and the specific gravity was 1.26.

Production Example 11

Synthesis of Polyester Resin (A-3)

Into a reaction vessel were loaded 461 parts (2.8 moles) of isophthalic acid, 308 parts (1.9 moles) of phthalic acid, 575 parts (9.3 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 88 parts (0.46 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 224 parts (3.6 moles). The resulting resin was cooled to room temperature, and then pulverized into a particle. This was defined as a polyester resin (A-3).

As for the polyester resin (A-3), the Tg was 57° C., the Tm was 138° C., the Mp was 6700, the AV was 28, the OHV was 1, the THF insoluble matter was 1%, and the specific gravity was 1.25.

Production Example 12

Synthesis of Polyester Resin (A-4)

Into a reaction vessel were loaded 310 parts (1.9 moles) of terephthalic acid, 465 parts (2.8 moles) of isophthalic acid, 36 parts (0.25 moles) of adipic acid, 610 parts (9.8 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 52 parts (0.27 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 262 parts (4.2 moles). The resulting resin was cooled to room temperature, and then pulverized into a particle. This was defined as a polyester resin (A-4).

As for the polyester resin (A-4), the Tg was 60° C., the Tm was 150° C., the Mp was 10500, the AV was 10, the OHV was 0, the THF insoluble matter was 1%, and the specific gravity was 1.25.

Production Example 13

Synthesis of Polyester Resin (A-5)

Into a reaction vessel were loaded 440 parts (2.7 moles) of terephthalic acid, 235 parts (1.4 moles) of isophthalic acid, 7 parts (0.05 moles) of adipic acid, 554 parts (8.9 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 103 parts (0.54 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 219 parts (3.5 moles). The resulting resin was cooled to room temperature, and then pulverized into a particle. This was defined as a polyester resin (A-5).

As for the polyester resin (A-5), the Tg was 56° C., the Tm was 135° C., the Mp was 4800, the AV was 37, the OHV was 50, the THF insoluble matter was 5%, and the specific gravity was 1.24.

Production Example 14

Synthesis of Polyester Resin (A-6)

Into a reaction vessel were loaded 200 parts (0.07 moles) of polyester resin (a-1) and 800 parts of tetrahydrofuran, and heated to 80° C. so that the (a-1) was dissolved therein. To this was added 60 parts (0.27 moles) of isophorone diisocyanate (hereinafter, referred to as IPDI) under a nitrogen gas flow and allowed to react for 24 hours. To this was further added 23 parts (0.13 moles) of isophorone diamine (hereinafter, referred to as IPDA), and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-6).

As for the polyester resin (A-6), the Tg was 60° C., the Tm was 145° C., the Mp was 7600, the Tf was 95° C., the AV was 45, the OHV was 2, the THF insoluble matter was 5%, and the specific gravity was 1.28. An equivalent ratio [OH]/[NCO] between a hydroxyl group of the (a-1) and an isocyanate group of IPDI was 1/1.9, an equivalent ratio [NCO]/[$NH_2$] between an unreacted isocyanate group of the reaction product of the (a-1) and IPDI and an amino group of IPDA was 1/1, the total content of constituent units of polyisocyanate and polyamine in the polyester resin (A-6) was 20.9%, and the mole ratio of urethane group/urea group was 1.2/1.

Production Example 15

Synthesis of Polyester Resin (A-7)

Into a reaction vessel were loaded 200 parts (0.07 moles) of the polyester resin (a-2) and 800 parts of tetrahydrofuran, and heated to 80° C. so that the (a-2) was dissolved therein. To this was added 60 parts (0.27 moles) of IPDI under a nitrogen gas flow and allowed to react for 24 hours. To this was further added 23 parts (0.13 moles) of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-7).

As for the polyester resin (A-7), the Tg was 59° C., the Tm was 140° C., the Mp was 7300, the Tf was 88° C., the AV was 45, the OHV was 1, the THF insoluble matter was 4%, and the specific gravity was 1.28. An equivalent ratio [OH]/[NCO] between a hydroxyl group of the (a-2) and an isocyanate group of IPDI was 1/1.89, an equivalent ratio [NCO]/[$NH_2$] between an unreacted isocyanate group of the reaction product of the (a-2) and IPDI and an amino group of IPDA was 0.95/1, the total content of constituent units of polyisocyanate and polyamine in the polyester resin (A-7) was 29.3%, and the mole ratio of urethane group/urea group was 1/1.

Production Example 16

Synthesis of Polyester Resin (A-8)

Into a reaction vessel was loaded 473 parts (7.6 moles) of ethylene glycol, and to this were added 50 parts (0.22 moles) of IPDI and 80 parts of tetrahydrofuran under a nitrogen gas flow and uniformly mixed. Into a dropping funnel were loaded 100 parts (1.6 moles) of ethylene glycol and 20 parts (0.12 moles) of IPDA, and uniformly mixed. The dropping funnel was attached to the reaction vessel, and a dropping process was carried out for 60 minutes, and these were uniformly mixed for 30 minutes at 20° C. so that IPDI and IPDA were allowed to react with each other. Thereafter, the temperature of the reaction vessel was raised to 80° C., and a stirring process was carried out for 4 hours so that an isocyanate group of the reaction product of IPDI and IPDA and a hydroxyl group of ethylene glycol were allowed to react with each other so that a mixture of ethylene glycol (9.1 moles) and modified polyols (0.12 moles) was obtained. Next, to this were added 460 parts (2.8 moles) of terephthalic acid, 307 parts (1.8 moles) of isophthalic acid, 52 parts (0.27 moles) of trimellitic anhydride and 3 parts of tetrabutoxy titanate serving as a condensing catalyst, and these were allowed to react with one another at 180° C. under a nitrogen gas flow for 8 hours, while generated water and ethylene glycol being distilled off, and then further allowed to react under a reduced pressure of 5 to 20 mmHg for 3 hours so that the resulting matter was taken out. The recovered ethylene glycol was 220 parts (3.5 moles). The resin thus taken out was cooled to room temperature, and then pulverized into a particle. This was defined as a polyester resin (A-8).

As for the polyester resin (A-8), the Tg was 58° C., the Tm was 135° C., the Mp was 7000, the Tf was 88° C., the AV was 1, the OHV was 25, the THF insoluble matter was 6%, and the specific gravity was 1.28. An equivalent ratio [NCO]/[$NH_2$] between an isocyanate group of IPDI and an amino group of IPDA was 1.91/1, an equivalent ratio [OH]/[NCO] between a hydroxyl group of ethylene glycol and an isocyanate group of the reaction product of IPDI and IPDA was 429/1, and the total content of constituent units of polyisocyanate and polyamine in the polyester resin (A-8) was 19.7%, and the mole ratio of urethane group/urea group was 1/1.

Production Example 17

Synthesis of Polyester Resin (A-9)

A constant feeder was installed in S-1 type KC kneader (made by Kurimoto, Ltd.), and the temperature was controlled to 200° C. Into another container were loaded 200 parts (0.07 moles) of the polyester resin (a-2) and 47 parts (0.28 moles) of hexamethylene diisocyanate (hereinafter, referred to as HDI) and uniformly mixed by a Henschel mixer, and this was put into the constant feeder. The constant feeder was adjusted so that the residence time for the reaction was set to 10 minutes. The resulting reaction product was cooled to room temperature, and then pulverized into a particle. To 247 parts (0.07 moles) of the powder thus obtained was added 16 parts (0.14 moles) of 1,6-hexamethylenediamine (hereinafter, referred to as HDA), and uniformly mixed by a Henschel mixer, and this was again put into the constant feeder. The constant feeder was adjusted so that the residence time for the reaction was set to 15 minutes. The resulting reaction product was cooled to room temperature, and then pulverized into a particle. This was defined as a polyester resin (A-9).

As for the polyester resin (A-9), the Tg was 58° C., the Tm was 145° C., the Mp was 7800, the Tf was 96° C., the AV was 43, the OHV was 2, the THF insoluble matter was 5%, and the specific gravity was 1.29. An equivalent ratio [OH]/[NCO] between a hydroxyl group of the (a-2) and an isocyanate group of HDI was 1/2.6, an equivalent ratio [NCO]/[$NH_2$] between an unreacted isocyanate group of the reaction product of the (a-2) and HDI and an amino group of HDA was 0.75/1, and the total content of constituent units of polyisocyanate and polyamine in the polyester resin (A-9) was 24%, and the mole ratio of urethane group/urea group was 1/1.

Production Example 18

Synthesis of Polyester Resin (A-10)

Into a reaction vessel was loaded 473 parts (7.6 moles) of ethylene glycol, and to this were added 38 parts (0.23 moles) of HDI and 40 parts of tetrahydrofuran under a nitrogen gas flow and uniformly mixed. Into a dropping funnel were loaded 100 parts (1.6 moles) of ethylene glycol and 14 parts (0.12 moles) of HDA, and uniformly mixed. The dropping funnel was attached to the reaction vessel, and a dropping process was carried out for 60 minutes, and these were uniformly mixed for 30 minutes at 20° C. so that HDI and HDA were allowed to react with each other. Thereafter, the temperature of the reaction vessel was raised to 80° C., and a stirring process was carried out for 4 hours so that an isocyanate group of the reaction product of HDI and HDA and a hydroxyl group of ethylene glycol were allowed to react with each other so that a mixture of ethylene glycol (9.1 moles) and a modified polyol (0.12 moles) was obtained. Next, to this were added 307 parts (1.8 moles) of terephthalic acid, 460 parts (2.8 moles) of isophthalic acid, 52 parts (0.27 moles) of trimellitic anhydride and 3 parts of tetrabutoxy titanate serving as a condensing catalyst, and these were allowed to react with one another at 180° C. under a nitrogen gas flow for 8 hours, while generated water and ethylene glycol being distilled off, and then further allowed to react under a reduced pressure of 5 to 20 mmHg for 3 hours so that the resulting matter was taken out. The recovered ethylene glycol was 223 parts (3.6 moles). The resin thus taken out was cooled to room temperature, and then pulverized into a particle. This was defined as a polyester resin (A-10).

As for the polyester resin (A-10), the Tg was 57° C., the Tm was 143° C., the Mp was 7600, the Tf was 93° C., the AV was 0, the OHV was 23, the THF insoluble matter was 5%, and the specific gravity was 1.29. An equivalent ratio [NCO]/[$NH_2$] between an isocyanate group of HDI and an amino group of HDA was 1.91/1, an equivalent ratio [OH]/[NCO] between a hydroxyl group of ethylene glycol and an isocyanate group of the reaction product of HDI and HDA was 429/1, and the total content of constituent units of polyisocyanate and polyamine in the polyester resin (A-10) was 19.9%, and the mole ratio of urethane group/urea group was 0.96/1.

Production Example 19

Synthesis of Polyester Resin (A-11)

Into a reaction vessel were loaded 100 parts of polyester resin (a-3) and 400 parts of tetrahydrofuran, and heated to 80° C. To this was added 23 parts of IPDI under a nitrogen gas flow and allowed to react for 24 hours. To this was further added 8.5 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-11).

As for the polyester resin (A-11), the Tg was 60° C., the Tm was 131° C., the Mp was 8700, the Tf was 82° C., the AV was 1, the OHV was 0, the THF insoluble matter was 2%, and the specific gravity was 1.28. An equivalent ratio [OH]/[NCO] between a hydroxyl group of the (a-3) and an isocyanate group of IPDI was 1/2.1, an equivalent ratio [NCO]/[$NH_2$] between an unreacted isocyanate group of the reaction product of the (a-3) and IPDI and an amino group of IPDA was 1.07/1, the total content of constituent units of polyisocyanate and polyamine in the polyester resin (A-11) was 24%, and the mole ratio of urethane group/urea group was 0.93/1.

Production Example 20

Synthesis of Polyester Resin (A-12)

Into a reaction vessel were loaded 100 parts of the polyester resin (a-4) and 400 parts of tetrahydrofuran, and heated to 80° C. To this was added 17 parts of IPDI under a nitrogen gas flow and allowed to react for 24 hours. To this was further added 6.4 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-12).

As for the polyester resin (A-12), the Tg was 61° C., the Tm was 148° C., the Mp was 11400, the Tf was 97° C., the AV was 2, the OHV was 1, the THF insoluble matter was 1%, and the specific gravity was 1.29. An equivalent ratio [OH]/[NCO] between a hydroxyl group of the (a-4) and an isocyanate group of IPDI was 1/2.2, an equivalent ratio [NCO]/[$NH_2$] between an unreacted isocyanate group of the reaction product of the (a-4) and IPDI and an amino group of IPDA was 1.09/1, the total content of constituent units of polyisocyanate and polyamine in the polyester resin (A-11) was 19%, and the mole ratio of urethane group/urea group was 0.87/1.

Production Example 21

Synthesis of Polyester Resin (A-13)

Into a reaction vessel were loaded 100 parts of the polyester resin (a-5) and 400 parts of tetrahydrofuran, and heated to 80° C. To this was added 25 parts of IPDI under a nitrogen gas flow and allowed to react for 24 hours. To this was further added 9.3 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-13).

As for the polyester resin (A-13), the Tg was 57° C., the Tm was 126° C., the Mp was 7800, the Tf was 79° C., the AV was 1, the OHV was 1, the THF insoluble matter was 3%, and the specific gravity was 1.28. An equivalent ratio [OH]/[NCO] between a hydroxyl group of the (a-5) and an isocyanate group of IPDI was 1/2.1, an equivalent ratio [NCO]/[$NH_2$] between an unreacted isocyanate group of the reaction product of the (a-5) and IPDI and an amino group of IPDA was 1.07/1, the total content of constituent units of polyisocyanate and polyamine in the polyester resin (A-11) was 26%, and the mole ratio of urethane group/urea group was 0.92/1.

Production Example 22

Synthesis of Polyester Resin (A-14)

Into a reaction vessel were loaded 100 parts of the polyester resin (a-6) and 400 parts of tetrahydrofuran, and heated to 80° C. To this was added 55 parts of IPDI under a nitrogen gas flow and allowed to react for 24 hours. To this was further added 21 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-14).

As for the polyester resin (A-14), the Tg was 63° C., the Tm was 187° C., the Mp was 16800, the Tf was 128° C., the AV was 0, the OHV was 1, the THF insoluble matter was 1%, and the specific gravity was 1.29. An equivalent ratio [OH]/[NCO] between a hydroxyl group of the (a-6) and an isocyanate group of IPDI was 1/7.7, an equivalent ratio [NCO]/[$NH_2$] between an unreacted isocyanate group of the reaction product of the (a-6) and IPDI and an amino group of IPDA was 1.75/1, the total content of constituent units of polyisocyanate and polyamine in the polyester resin (A-11) was 43%, and the mole ratio of urethane group/urea group was 0.14/1.

Production Example 23

Synthesis of Polyester Resin (A-15)

Into a reaction vessel were loaded 100 parts of the polyester resin (a-7) and 400 parts of tetrahydrofuran, and heated to 80°

C. To this was added 24 parts of IPDI under a nitrogen gas flow and allowed to react for 24 hours. To this was further added 9.0 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-15).

As for the polyester resin (A-15), the Tg was 58° C., the Tm was 121° C., the Mp was 8400, the Tf was 76° C., the AV was 1, the OHV was 0, the THF insoluble matter was 2%, and the specific gravity was 1.28. An equivalent ratio [OH]/[NCO] between a hydroxyl group of the (a-7) and an isocyanate group of IPDI was 1/2.1, an equivalent ratio [NCO]/[$NH_2$] between an unreacted isocyanate group of the reaction product of the (a-7) and IPDI and an amino group of IPDA was 1.07/1, the total content of constituent units of polyisocyanate and polyamine in the polyester resin (A-11) was 25%, and the mole ratio of urethane group/urea group was 0.91/1.

Production Example 24

Synthesis of Polyester Resin (A-16)

Into a reaction vessel were loaded 100 parts of polyester resin (a-8) and 400 parts of tetrahydrofuran, and heated to 80° C. To this was added 80 parts of IPDI under a nitrogen gas flow and allowed to react for 24 hours. To this was further added 31 parts of IPDA, and after being stirred for 3 hours, tetrahydrofuran was distilled off for 10 hours under a reduced pressure of 5 to 20 mmHg, while being heated to 200° C., so that the resulting matter was taken out. The resin thus taken out was cooled to room temperature, and then pulverized into a particle. This was defined as a polyester resin (A-16).

As for the polyester resin (A-16), the Tg was 57° C., the Tm was 225° C., the Mp was 11400, the Tf was 175° C., the AV was 1, the OHV was 0, the THF insoluble matter was 2%, and the specific gravity was 1.28. An equivalent ratio [OH]/[NCO] between a hydroxyl group of the (a-8) and an isocyanate group of IPDI was 1/8.3, an equivalent ratio [NCO]/[$NH_2$] between an unreacted isocyanate group of the reaction product of the (a-8) and IPDI and an amino group of IPDA was 1.73/1, the total content of constituent units of polyisocyanate and polyamine in the polyester resin (A-11) was 53%, and the mole ratio of urethane group/urea group was 0.14/1.

Production Example 25

Synthesis of Polyester Resin (A-17)

Into a reaction vessel were loaded 440 parts (2.7 moles) of terephthalic acid, 235 parts (1.4 moles) of isophthalic acid, 7 parts (0.05 moles) of adipic acid, 30 parts (0.25 moles) of benzoic acid, 554 parts (8.9 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 103 parts (0.54 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 219 parts (3.5 moles). The resulting resin was cooled to room temperature, and then pulverized into a particle. This was defined as a polyester resin (A-17).

As for the polyester resin (A-17), the Tg was 56° C., the Tm was 138° C., the Mp was 4900, the AV was 35, the OHV was 28, the THF insoluble matter was 5%, and the specific gravity was 1.24.

Production Example 26

Synthesis of Polyester Resin (A-18)

Into a reaction vessel were loaded 461 parts (2.8 moles) of isophthalic acid, 308 parts (1.9 moles) of phthalic acid, 15 parts (0.12 moles) of benzoic acid, 575 parts (9.3 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and then further allowed to react under a reduced pressure of 5 to 20 mmHg for one hour. Next, to this was added 88 parts (0.46 moles) of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 224 parts (3.6 moles). The resulting resin was cooled to room temperature, and then pulverized into a particle. This was defined as a polyester resin (A-18).

As for the polyester resin (A-18), the Tg was 57° C., the Tm was 138° C., the Mp was 6700, the AV was 21, the OHV was 0, the THF insoluble matter was 1%, and the specific gravity was 1.25.

Production Example 27

Synthesis of Linear Polyester Resin (B-1)

Into a reaction vessel were loaded 2990 parts (18.0 moles) of terephthalic acid, 7660 parts (23.4 moles) of an adduct of bisphenol A with 2 moles of ethylene oxide, and 3 parts of tetrabutoxy titanate serving as a condensing catalyst, and these were allowed to react with one another at 230° C. under a nitrogen gas flow for 5 hours, while generated water being distilled off. Next, this was then further allowed to react under a reduced pressure of 5 to 20 mmHg, and when its softening point reached 94° C., the generated polymer was taken out, and after being cooled to room temperature, the polymer was pulverized into a particle. This was defined as a linear polyester resin (B-1).

As for the linear polyester resin (B-1), the Tg was 60° C., the Tm was 94° C., the Mp was 3500, the Mn was 1800, the AV was 2, the OHV was 55, the THF insoluble matter was 0%, and the specific gravity was 1.20.

Production Example 28

Synthesis of Linear Polyester Resin (B-2)

Into a reaction vessel were loaded 2300 parts (13.9 moles) of terephthalic acid, 8198 parts (23.4 moles) of an adduct of bisphenol A with 2 moles of ethylene oxide, and 3 parts of tetrabutoxy titanate serving as a condensing catalyst, and these were allowed to react with one another at 230° C. under a nitrogen gas flow for 5 hours, while generated water being distilled off. Next, this was then further allowed to react under a reduced pressure of 5 to 20 mmHg, and when its AV reached 2 or less, the resulting polymer was cooled to 180° C., and to this was then added 1283 parts (6.7 moles) of trimellitic anhydride, and after being kept at 180° C. for one hour, the resulting resin was taken out. The resin thus taken out was cooled to room temperature, and then pulverized into a particle. This was defined as a linear polyester resin (B-2).

As for the linear polyester resin (B-2), the Tg was 61° C., the Tm was 93° C., the Mp was 2000, the Mn was 1400, the AV was 58, the OHV was 73, the THF insoluble matter was 0%, and the specific gravity was 1.20.

Production Example 29

Synthesis of Linear Polyester Resin (B-3)

The aforementioned polyester resin (a-2) was formed into a linear polyester resin (B-3).

As for the linear polyester resin (B-3), the Tg was 59° C., the Tm was 97° C., the Mp was 7000, the Mn was 1800, the AV was 49, the OHV was 77, the THF insoluble matter was 0%, and the specific gravity was 1.19.

Production Example 30

Synthesis of Linear Polyester Resin (B-4)

The aforementioned polyester resin (a-1) was formed into a linear polyester resin (B-4).

As for the linear polyester resin (B-4), the Tg was 60° C., the Tm was 96° C., the Mp was 3800, the Mn was 1700, the AV was 50, the OHV was 79, the THF insoluble matter was 0%, and the specific gravity was 1.20.

Production Example 31

Synthesis of Linear Polyester Resin (B-5)

Into a reaction vessel were loaded 219 parts of terephthalic acid, 214 parts of an adduct of bisphenol A with 3 moles of propylene oxide, 400 parts of an adduct of bisphenol A with 2 moles of ethylene oxide, and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg, and when its AV reached 2 or less, the resulting polymer was cooled to 180° C., and to this was then added 59 parts of trimellitic anhydride, and after being allowed to react in a closed state under normal pressure for 2 hours, the resulting resin was cooled to room temperature, and then pulverized into a particle. This was defined as a linear polyester resin (B-5).

As for the linear polyester resin (B-5), the Tg was 55° C., the Tm was 76° C., the Mp was 3600, the Mn was 1800, the AV was 41, the OHV was 42, the THF insoluble matter was 0%, and the specific gravity was 1.21.

Production Example 32

Synthesis of Linear Polyester Resin (B-6)

Into a reaction vessel were loaded 412 parts of terephthalic acid, 412 parts of isophthalic acid, 800 parts of ethylene glycol, and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 20 to 40 mmHg so that the resulting matter with a predetermined viscosity was taken out. The recovered ethylene glycol and combined water were 318 parts. After being cooled to 180° C., to this was added 71 parts of trimellitic anhydride, and after being allowed to react in a closed state under normal pressure for 2 hours, the resulting resin was cooled to room temperature, and then pulverized into a particle. This was defined as a linear polyester resin (B-6).

As for the linear polyester resin (B-6), the Tg was 56° C., the Tm was 85° C., the Mp was 4000, the Mn was 2000, the AV was 39, the OHV was 36, the THF insoluble matter was 0%, and the specific gravity was 1.21.

Comparative Production Example 1

Synthesis of Comparative Polyester Resin (RA-1)

Into a reaction vessel were loaded 41 parts (0.13 moles) of an adduct of bisphenol A with 2 moles of ethylene oxide, 457 parts (1.14 moles) of an adduct of bisphenol A with 3 moles of propylene oxide, 9 parts (0.01 moles) of an adduct of phenol novolak (average number of functional groups: 5.6) with 6 moles of propylene oxide, 166 parts (1.0 mole) of terephthalic acid, 93 parts of fumaric acid (0.8 moles) and 3 parts of tetrabutoxy titanate serving as a condensing catalyst, and these were allowed to react with one another at 230° C. under a nitrogen gas flow for 5 hours, while generated water being distilled off. Next, this was then further reacted under a reduced pressure of 5 to 20 mmHg, and when its AV reached 2 or less, the resulting polymer was cooled to 180° C., and to this was then added 41 parts (0.21 moles) of trimellitic anhydride, and after being allowed to react in a closed state under normal pressure for 2 hours, this was further allowed to react at 230° C. under a reduced pressure of 5 to 20 mmHg, and when its Tm reached 132° C., the resulting matter was taken out. The resin thus taken out was cooled to room temperature, and then pulverized into a particle. This was defined as a polyester resin (RA-1).

As for the polyester resin (RA-1), the Tg was 58° C., the Tm was 135° C., the Mp was 11300, the AV was 20, the OHV was 5, the THF insoluble matter was 6%, and the specific gravity was 1.24.

Comparative Production Example 2

Synthesis of Comparative Polyester Resin (RA-2)

Into a reaction vessel were loaded 486 parts (1.21 moles) of an adduct of bisphenol A with 3 moles of propylene oxide, 23 parts (0.29 moles) of an adduct of phenol novolak (average number of functional groups: 5.6) with 6 moles of propylene oxide, 166 parts (1.0 mole) of terephthalic acid and 3 parts of tetrabutoxy titanate serving as a condensing catalyst, and these were allowed to react with one another at 230° C. under a nitrogen gas flow for 5 hours, while generated water being distilled off. This was then further allowed to react under a reduced pressure of 5 to 20 mmHg, and when its AV reached 2 or less, the resulting polymer was cooled to 180° C., and to this was then added 40 parts (0.21 moles) of trimellitic anhydride, and after being allowed to react in a closed state under normal pressure for 2 hours, this was further allowed to react at 230° C. under a reduced pressure of 5 to 20 mmHg, and when its Tm reached 140° C., the resulting matter was taken out. The resin thus taken out was cooled to room temperature, and then pulverized into a particle. This was defined as a polyester resin (RA-2).

As for the polyester resin (RA-2), the Tg was 57° C., the Tm was 145° C., the Mp was 8300, the AV was 20, the OHV was 18, the THF insoluble matter was 28%, and the specific gravity was 1.23.

Comparative Production Example 3

Synthesis of Comparative Polyester Resin (RA-3)

Into a reaction vessel were loaded 767 parts (4.6 moles) of terephthalic acid, 573 parts (9.2 moles) of ethylene glycol and 0.5 parts of tetrabutoxy titanate serving as a polymerization catalyst, and these were allowed to react with one another at 210° C. under a nitrogen gas flow for 5 hours, while generated water and ethylene glycol being distilled off, and this was then further allowed to react under a reduced pressure of 5 to 20 mmHg for one hour. Next, to this was added 88 parts (0.46 moles) of trimellitic anhydride, and after being reacted under normal pressure for one hour, these were further allowed to react under a reduced pressure of 20 to 40 mmHg for 4 hours so that the resulting matter was taken out. The recovered ethylene glycol was 245 parts (4.0 moles). The resulting resin was cooled to room temperature, and then pulverized into a particle. This was defined as a polyester resin (RA-3). The resulting resin was in a white clouded state, the Tm thereof was 220° C., the Tg was 150° C., and since this was insoluble in THF, Mp measurements were not carried out. Since this could not be used as a toner binder, evaluation thereof was suspended.

Comparative Production Example 4

Synthesis of Comparative Polyester Resin (RA-4)

Into a reaction vessel were loaded 470 parts of terephthalic acid, 311 parts of phthalic acid, 599 parts of ethylene glycol and 0.5 parts of tetrabutoxy titanate serving as a polymerization catalyst, and these were allowed to react with one another at 210° C. under a nitrogen gas flow for 5 hours, while generated water being distilled off, and then further allowed to react under a reduced pressure of 5 to 20 mmHg for one hour. Next, to this was added 83 parts of trimellitic anhydride, and after being allowed to react under normal pressure for one hour, these were further allowed to react under a reduced pressure of 20 to 40 mmHg so that the resulting matter with a predetermined softening point was taken out. The recovered ethylene glycol was 235 parts. The resulting resin was cooled to room temperature, and then pulverized into a particle. This was defined as a polyester resin (RA-4).

As for the polyester resin (RA-4), the Tg was 59° C., the Tm was 142° C., the Mp was 8400, the AV was 1, the OHV was 19, the THF insoluble matter was 2%, and the specific gravity was 1.23.

Comparative Production Example 5

Synthesis of Comparative Polyester Resin (RA-5)

Into a reaction vessel were loaded 690 parts of an adduct of bisphenol A with 3 moles of ethylene oxide, 40 parts (0.01 moles) of an adduct of phenol novolak (average number of functional groups: 5.6) with 6 moles of propylene oxide, 300 parts of terephthalic acid and 2 parts of tetrabutoxy titanate serving as a condensing catalyst, and these were allowed to react with one another at 230° C. under a nitrogen gas flow for 5 hours, while generated water being distilled off. This was then further allowed to react under a reduced pressure of 5 to 20 mmHg, and when its AV reached 2 or less, the resulting polymer was cooled to 180° C., and to this was then added 90 parts of trimellitic anhydride, and after being allowed to react in a closed state under normal pressure for 2 hours, this was further allowed to react at 230° C. under a reduced pressure of 5 to 20 mmHg, and when its Tm reached 133° C., the resulting matter was taken out. The resin thus taken out was cooled to room temperature, and then pulverized into a particle. This was defined as a polyester resin (RA-5).

As for the polyester resin (RA-5), the Tg was 60° C., the Tm was 133° C., the Mp was 4800, the AV was 41, the OHV was 10, the THF insoluble matter was 8%, and the specific gravity was 1.23.

Examples 1 to 24

Comparative Examples 1 to 5

The polyester resins (A-1) to (A-18) and (B-1) to (B-6), obtained in the above-mentioned production examples, and the polyester resins (RA-1) to (RA-5), obtained in the comparative production examples, were blended based upon composition ratios (parts) shown in Table 1 and Table 2 so that a toner binder of the present invention made from a polyester resin (P) and a comparative toner binder were obtained, and these were formed into toners by using the following way. (Carbon Black MA-100 (made by Mitsubishi Chemical Inc.), carnauba wax, Charge controlling agent T-77 (made by Hodogaya Chemical Co., Ltd.)).

First, after being preliminarily mixed by a Henschel mixer (FM10B made by Mitsui Mining Co., Ltd.), the mixture was kneaded at 140° C. by using a biaxial kneader (PCM-30 made by Ikegai Corp.). Next, after being finely pulverized with a supersonic jet pulverizer Labo Jet (made by Nippon Pneumatic Mfg. Co., Ltd.), the resulting particles were classified with an airflow classifier (MDS-1, made by Nippon Pneumatic Mfg. Co., Ltd.) so that toner particles having a particle size (D50) of 8 μm were obtained. Next, to 100 parts of toner particles 0.5 parts of colloidal silica (Aerosil R972 made by Nippon Aerosil Co., Ltd.) was added and these were mixed in a sample mill so that toner compositions (T-1) to (T-24) of the present invention and comparative toner compositions (RT-1) to (RT-5) were obtained.

Table 3 and Table 4 show the results of evaluations carried out by the following evaluation method.

TABLE 1

| Name of material | | | Example 1 T-1 | 2 T-2 | 3 T-3 | 4 T-4 | 5 T-5 | 6 T-6 | 7 T-7 | 8 T-8 | 9 T-9 | 10 T-10 | 11 T-11 | 12 T-12 | 13 T-13 | 14 T-14 | 15 T-15 |
|---|---|---|---|---|---|---|---|---|---|---|---|---|---|---|---|---|---|
| Production example | 9 | A-1 | 80 | — | — | — | — | — | — | — | — | — | — | — | — | — | — |
| | 10 | A-2 | — | 80 | — | — | — | — | — | — | — | — | — | — | — | — | — |
| | 11 | A-3 | — | — | 50 | — | — | — | — | — | — | — | — | — | — | — | — |
| | 12 | A-4 | — | — | — | 80 | — | — | 30 | — | — | — | — | — | — | — | — |
| | 13 | A-5 | — | — | — | — | 100 | 80 | — | — | — | — | — | — | — | — | — |
| | 14 | A-6 | — | — | — | — | — | — | — | 20 | — | — | — | — | — | — | — |
| | 15 | A-7 | — | — | — | — | — | — | — | — | 30 | — | — | — | — | — | — |
| | 16 | A-8 | — | — | — | — | — | — | — | — | — | 20 | — | — | — | — | — |
| | 17 | A-9 | — | — | — | — | — | — | — | — | — | — | 15 | — | — | — | — |
| | 18 | A-10 | — | — | — | — | — | — | — | — | — | — | — | 15 | — | — | — |
| | 19 | A-11 | — | — | — | — | — | — | — | — | — | — | — | — | 70 | — | — |
| | 20 | A-12 | — | — | — | — | — | — | — | — | — | — | — | — | — | 70 | — |
| | 21 | A-13 | — | — | — | — | — | — | — | — | — | — | — | — | — | — | 70 |
| | 27 | B-1 | 20 | — | — | — | — | — | — | — | — | — | — | — | — | — | — |
| | 28 | B-2 | — | 20 | — | — | — | — | — | — | — | — | — | — | — | — | — |
| | 29 | B-3 | — | — | 50 | — | — | — | 70 | — | 70 | 80 | 85 | 85 | — | — | — |
| | 30 | B-4 | — | — | — | 20 | — | 20 | — | 80 | — | — | — | — | — | — | — |
| | 31 | B-5 | — | — | — | — | — | — | — | — | — | — | — | — | 30 | 30 | 30 |
| Carbon black MA-100 | | | 8 | 8 | 8 | 8 | 8 | 8 | 8 | 8 | 8 | 8 | 8 | 8 | 8 | 8 | 8 |
| Carnauba wax | | | 5 | 5 | 5 | 5 | 5 | 5 | 5 | 5 | 5 | 5 | 5 | 5 | 5 | 5 | 5 |
| Charge controlling agent T-77 | | | 1 | 1 | 1 | 1 | 1 | 1 | 1 | 1 | 1 | 1 | 1 | 1 | 1 | 1 | 1 |

TABLE 2

| Name of material | | | Example 16 T-16 | 17 T-17 | 18 T-18 | 19 T-19 | 20 T-20 | 21 T-21 | 22 T-22 | 23 T-23 | 24 T-24 | Comparative Example 1 RT-1 | 2 RT-2 | 3 RT-3 | 4 RT-4 | 5 RT-5 |
|---|---|---|---|---|---|---|---|---|---|---|---|---|---|---|---|---|
| Production example | 22 | A-14 | 70 | — | — | — | — | — | — | — | — | — | — | — | — | — |
| | 23 | A-15 | — | 70 | — | 60 | 80 | 70 | — | — | — | — | — | — | — | — |
| | 24 | A-16 | — | — | 70 | — | — | — | — | — | — | — | — | — | — | — |
| | 25 | A-17 | — | — | — | — | — | — | 100 | 80 | — | — | — | — | — | — |
| | 26 | A-18 | — | — | — | — | — | — | — | — | 50 | — | — | — | — | — |
| | 27 | B-1 | — | — | — | — | — | — | — | — | — | 10 | — | — | — | — |
| | 28 | B-2 | — | — | — | — | — | — | — | — | — | — | 40 | — | — | — |
| | 29 | B-3 | — | — | — | — | — | — | — | — | 50 | — | — | — | — | — |
| | 30 | B-4 | — | — | — | — | — | — | — | 20 | — | — | — | — | — | — |
| | 31 | B-5 | 30 | 30 | 30 | 40 | 20 | — | — | — | — | — | — | — | 30 | 30 |
| | 32 | B-6 | — | — | — | — | — | 30 | — | — | — | — | — | — | — | — |
| Comparative Production Example | 1 | RA-1 | — | — | — | — | — | — | — | — | — | — | 60 | 100 | — | — |
| | 2 | RA-2 | — | — | — | — | — | — | — | — | — | 90 | — | — | — | — |
| | 4 | RA-4 | — | — | — | — | — | — | — | — | — | — | — | — | 70 | — |
| | 5 | RA-5 | — | — | — | — | — | — | — | — | — | — | — | — | — | 70 |
| Carbon black MA-100 | | | 8 | 8 | 8 | 8 | 8 | 8 | 8 | 8 | 8 | 8 | 8 | 8 | 8 | 8 |
| Carnauba wax | | | 5 | 5 | 5 | 5 | 5 | 5 | 5 | 5 | 5 | 5 | 5 | 5 | 5 | 5 |
| Charge controlling agent T-77 | | | 1 | 1 | 1 | 1 | 1 | 1 | 1 | 1 | 1 | 1 | 1 | 1 | 1 | 1 |

TABLE 3

| Evaluation item | Example 1 T-1 | 2 T-2 | 3 T-3 | 4 T-4 | 5 T-5 | 6 T-6 | 7 T-7 | 8 T-8 |
|---|---|---|---|---|---|---|---|---|
| [G'150] of (A) [dyn/cm$^2$] | 33000 | 46000 | 27000 | 62000 | 50000 | 50000 | 62000 | 28000 |
| Eta [Tg + 40] of (A) [Pa · s] | $4 \times 10^5$ | $4 \times 10^5$ | $2 \times 10^5$ | $6 \times 10^5$ | $5 \times 10^5$ | $5 \times 10^5$ | $6 \times 10^5$ | $2 \times 10^5$ |
| [G'150]/[G'180] of (A) | 13 | 12 | 14 | 12 | 10 | 10 | 12 | 5 |
| Eta [Tg + 40] of (P) [Pa · s] | $4 \times 10^5$ | $4 \times 10^5$ | $2 \times 10^5$ | $6 \times 10^5$ | $5 \times 10^5$ | $3 \times 10^5$ | $6 \times 10^5$ | $2 \times 10^5$ |
| [G'150] of (P) [dyn/cm$^2$] | 32000 | 45000 | 27000 | 60000 | 50000 | 42000 | 20000 | 27000 |
| [G'150]/[G'180] of (P) | 12 | 11 | 13 | 11 | 10 | 10 | 12 | 5 |
| Glass transition temperature (Tg) of (P) [° C.] | 60 | 59 | 59 | 60 | 56 | 57 | 59 | 60 |

TABLE 3-continued

| | | | | | | | | |
|---|---|---|---|---|---|---|---|---|
| Peak top molecular weight (Mp) of (P) | 5400 | 5400 | 5200 | 8600 | 4800 | 4000 | 4800 | 5200 |
| Minimum fixing temperature (MFT) [° C.] | 145 | 145 | 130 | 150 | 150 | 140 | 115 | 110 |
| Hot offset generation temperature (HOT) [° C.] | 210 | 225 | 205 | 240 | 230 | 210 | 180 | 200 |
| Anti-blocking property of toner | ⊙ | ⊙ | ○ | ⊙ | ○ | ○ | ⊙ | ⊙ |

| | Example | | | | | | |
|---|---|---|---|---|---|---|---|
| Evaluation item | 9<br>T-9 | 10<br>T-10 | 11<br>T-11 | 12<br>T-12 | 13<br>T-13 | 14<br>T-14 | 15<br>T-15 |
| [G'150] of (A) [dyn/cm$^2$] | 77000 | 60000 | 29000 | 30000 | 26000 | 28000 | 23000 |
| Eta [Tg + 40] of (A) [Pa · s] | $4 \times 10^4$ | $2 \times 10^4$ | $8 \times 10^3$ | $8 \times 10^3$ | $4 \times 10^5$ | $4 \times 10^5$ | $2 \times 10^5$ |
| [G'150]/[G'180] of (A) | 5 | 5 | 6 | 5 | 2.5 | 1.8 | 3.3 |
| Eta [Tg + 40] of (P) [Pa · s] | $4 \times 10^4$ | $2 \times 10^4$ | $8 \times 10^3$ | $8 \times 10^3$ | $4 \times 10^5$ | $4 \times 10^5$ | $2 \times 10^5$ |
| [G'150] of (P) [dyn/cm$^2$] | 30000 | 26000 | 21000 | 20000 | 25000 | 27000 | 23000 |
| [G'150]/[G'180] of (P) | 5 | 5 | 6 | 5 | 2.5 | 1.8 | 3.3 |
| Glass transition temperature (Tg) of (P) [° C.] | 59 | 59 | 58 | 58 | 60 | 59 | 59 |
| Peak top molecular weight (Mp) of (P) | 4800 | 4500 | 4600 | 4600 | 5400 | 5400 | 5200 |
| Minimum fixing temperature (MFT) [° C.] | 120 | 115 | 110 | 110 | 130 | 140 | 125 |
| Hot offset generation temperature (HOT) [° C.] | 215 | 200 | 195 | 195 | 200 | 210 | 200 |
| Anti-blocking property of toner | ⊙ | ⊙ | ○ | ○ | ⊙ | ⊙ | ○ |

TABLE 4

| | Example | | | | | | |
|---|---|---|---|---|---|---|---|
| Evaluation item | 16<br>T-16 | 17<br>T-17 | 18<br>T-18 | 19<br>T-19 | 20<br>T-20 | 21<br>T-21 | 22<br>T-22 |
| [G'150] of (A) [dyn/cm$^2$] | 140000 | 20000 | 81000 | 20000 | 20000 | 20000 | 50000 |
| Eta [Tg + 40] of (A) [Pa · s] | $6 \times 10^5$ | $5 \times 10^5$ | $6 \times 10^5$ | $2 \times 10^5$ | $3 \times 10^5$ | $4 \times 10^5$ | $5 \times 10^5$ |
| [G'150]/[G'180] of (A) | 0.1 | 4.2 | 0.5 | 4.2 | 4.2 | 4.2 | 10 |
| Eta [Tg + 40] of (P) [Pa · s] | $6 \times 10^5$ | $5 \times 10^5$ | $6 \times 10^5$ | $2 \times 10^5$ | $3 \times 10^5$ | $4 \times 10^5$ | $5 \times 10^5$ |
| [G'150] of (P) [dyn/cm$^2$] | 61000 | 19000 | 52000 | 18000 | 20000 | 19000 | 49000 |
| [G'150]/[G'180] of (P) | 0.1 | 4.2 | 0.5 | 4.2 | 4.2 | 4.2 | 10 |
| Glass transition temperature (Tg) of (P) [° C.] | 60 | 56 | 56 | 56 | 57 | 57 | 55 |
| Peak top molecular weight (Mp) of (P) | 8600 | 4800 | 5000 | 4800 | 5500 | 4900 | 4900 |
| Minimum fixing temperature (MFT) [° C.] | 145 | 130 | 150 | 125 | 135 | 140 | 150 |
| Hot offset generation temperature (HOT) [° C.] | 230 | 190 | 230 | 170 | 200 | 200 | 230 |
| Anti-blocking property of toner | ⊙ | ○ | ⊙ | ○ | ⊙ | ○ | ⊙ |

| | Example | | Comparative Example | | | | |
|---|---|---|---|---|---|---|---|
| Evaluation item | 23<br>T-23 | 24<br>T-24 | 1<br>RT-1 | 2<br>RT-2 | 3<br>RT-3 | 4<br>RT-4 | 5<br>RT-5 |
| [G'150] of (A) [dyn/cm$^2$] | 50000 | 27000 | 8800 | 11000 | 30000 | 11000 | 8000 |
| Eta [Tg + 40] of (A) [Pa · s] | $5 \times 10^5$ | $2 \times 10^5$ | $6 \times 10^5$ | $2 \times 10^5$ | $1 \times 10^6$ | $6 \times 10^5$ | $6 \times 10^5$ |
| [G'150]/[G'180] of (A) | 10 | 14 | 21 | 25 | 15 | 18 | 20 |
| Eta [Tg + 40] of (P) [Pa · s] | $3 \times 10^5$ | $2 \times 10^5$ | $6 \times 10^5$ | $2 \times 10^5$ | $1 \times 10^6$ | $6 \times 10^5$ | $6 \times 10^5$ |
| [G'150] of (P) [dyn/cm$^2$] | 48000 | 27000 | 8000 | 9000 | 29000 | 10000 | 7000 |
| [G'150]/[G'180] of (P) | 10 | 13 | 19 | 25 | 15 | 17 | 18 |
| Glass transition temperature (Tg) of (P) [° C.] | 56 | 58 | 57 | 59 | 58 | 57 | 58 |
| Peak top molecular weight (Mp) of (P) | 4000 | 5200 | 7600 | 5600 | 11300 | 8000 | 7500 |
| Minimum fixing temperature (MFT) [° C.] | 140 | 130 | 150 | 135 | 160 | 155 | 150 |

TABLE 4-continued

| | | | | | | | |
|---|---|---|---|---|---|---|---|
| Hot offset generation temperature (HOT) [° C.] | 210 | 205 | 160 | 170 | 210 | 170 | 160 |
| Anti-blocking property of toner | ⊙ | ⊙ | ○ | ○ | ○ | ○ | ○ |

[Evaluation Method]

[1] Minimum Fixing Temperature (MFT)

Unfixed images developed by using a commercial copying machine (AR5030: made by Sharp Corp.) were evaluated by using a fixing device of the commercial copying machine (AR5030: made by Sharp Corp.). A fixed image was rubbed with a pad, and the lowest temperature at which the residual rate of the resulting image density was maintained at 70% or more was determined as the minimum fixing temperature.

[2] Hot Offset Generation Temperature (HOT)

The fixed state was evaluated in the same manner as in the MFT, and the presence or absence of hot offset on the fixed image was visually evaluated. The highest temperature, at which after a passage of a fixing roll, no hot offset generated, was determined as hot offset generation temperature.

[3] Anti-Blocking Property Test of Toner

The toner composition was moistened for 48 hours under a high temperature and humidity environment of 50° C. and 85% R.H. Under the same environment, the blocking state of the developer was visually determined, and the image quality of a copy obtained by using a commercial copying machine (AR5030: made by Sharp Co.) was observed.

Evaluation Criteria

⊙: No toner blocking was observed, and good image quality was obtained even after copying processes of 3000 sheets.

o: Although no toner blocking was observed, slight disturbances were observed after copying processes of 3000 sheets.

x: Toner blocking was visually observed, and no images were obtainable before copying processes of 3000 sheets.

INDUSTRIAL APPLICABILITY

The toner composition and toner binder of the present invention, which are superior in both of low-temperature fixing property and anti-hot offset property (expanding fixing temperature range) and also provide superior anti-blocking property, can be effectively applied to a toner and a toner binder for developing an electrostatically charged image that are used for electrophotography, electrostatic recording, electrostatic printing, or the like.

The invention claimed is:

1. A toner binder comprising: a polyester resin (P) containing at least 10% by weight of a polyester resin (A) that has at least a carboxylic acid component (x) and a polyol component (y) as constituent units, the carboxylic acid component (x) containing 80% or more by mole in total of two or more dicarboxylic acids (x1) selected from the group consisting of aromatic dicarboxylic acids and ester-forming derivatives thereof, and also containing trivalent or more polycarboxylic acid (x2), and the polyol component (y) containing 80% or more by mole of an aliphatic diol (y1) having 2 to 10 carbon atoms, wherein the polyester resin (A) has a storage elastic modulus of 20000 dyn/cm$^2$ or more at 150° C., and a storage elastic modulus represented by a dyn/cm$^2$ unit at 150° C. which is represented by G'150 and that a storage elastic modulus represented by a dyn/cm$^2$ unit at 180° C. which is represented by G'180 satisfy the following formula (1):

$$G'150/G'180 \leq 15 \quad \text{Formula (1).}$$

2. The toner binder according to claim 1, wherein the dicarboxylic acids (x1) constituting the polyester resin (A) are two or more selected from the group consisting of the following (1) to (3):

(1) terephthalic acid and/or ester-forming derivatives thereof, (2) isophthalic acid and/or ester-forming derivatives thereof, and (3) phthalic acid and/or ester-forming derivatives thereof.

3. The toner binder according to claim 2, wherein the polyester resin (A) is a modified polyester resin (A1) containing an urethane group and a urea group, that has a polyisocyanate (i) as well as a polyamine (j) and/or water as constituent units.

4. The toner binder according to claim 3, wherein the total content of the polyisocyanate (i), the polyamine (j) and water serving as the constituent units in the modified polyester resin (A1) is 55% by weight or less based upon the weight of the modified polyester resin (A1).

5. The toner binder according to claim 2, wherein a peak top molecular weight in gel permeation chromatography of a tetrahydrofuran soluble matter of the polyester resin (A) is 2000 to 20000.

6. The toner binder according to claim 2, wherein the polyester resin (A) has a glass transition temperature in a range from 30 to 75° C. and a softening point measured by a flow tester in a range from 120 to 170° C.

7. The toner binder according to claim 2, wherein a viscosity at the temperature of a glass transition point+40° C. of the polyester resin (A) indicated based upon Pa·s unit which is represented by Eta[Tg+40] satisfies the following formula (2):

$$Eta[Tg+40] \leq 7\times10^5 \quad \text{Formula (2).}$$

8. The toner binder according to claim 2, wherein the polyester resin (P) further contains a liner polyester resin (B).

9. The toner binder according to claim 8, wherein a peak top molecular weight in gel permeation chromatography of a tetrahydrofuran soluble matter of the linear polyester resin (B) is in a range from 1000 to 10000.

10. The toner binder according claim 8, wherein supposing that a total weight of the polyester resin (A) and the linear polyester resin (B) is 100, the linear polyester resin (B) has a content of 90% by weight or less.

11. The toner binder according to claim 1, wherein the polyester resin (A) is a modified polyester resin (A1) containing an urethane group and a urea group, that has a polyisocyanate (i) as well as a polyamine (j) and/or water as constituent units.

12. The toner binder according to claim 11, wherein the total content of the polyisocyanate (i), the polyamine (j) and water serving as the constituent units in the modified polyester resin (A1) is 55% by weight or less based upon the weight of the modified polyester resin (A1).

13. A method for producing the toner binder according to claim 11, comprising: producing the modified polyester resin (A1) by using any one of the following [1] to [3]:

[1] a method for producing the modified polyester resin (A1) that includes allowing a solution of a polyester resin (a) containing a hydroxyl group, obtained by polycondensing a carboxylic acid component (x) and a polyol component (y), in an organic solvent (S) to react with a polyisocyanate (i), and then allowing a reaction product having an unreacted isocyanate group to react with a polyamine (j) so that the modified polyester resin (A1) is produced;

[2] a method for producing the modified polyester resin (A1) that includes allowing a polyester resin (a) having a hydroxyl group, obtained by polycondensing a carboxylic acid component (x) and a polyol component (y), in its liquid state to react with a polyisocyanate (i), and then allowing a reaction product containing an unreacted isocyanate group to react with a polyamine (j) so that the modified polyester resin (A1) is produced; and

[3] a method for producing the modified polyester resin (A1) that includes allowing a polyisocyanate (i) and a polyamine (j) to reach with each other at an equivalent ratio of from 1.5/1 to 3/1=[isocyanate groups in (i)]/[amino groups in (j)], and then allowing a polyol component (y) containing a modified polyol (y1) obtained by reacting a reaction product containing an unreacted isocyanate group with the polyol component (y) to be polycondensed with a carboxylic component (x) so that the modified polyester resin (A1) is produced.

14. The toner binder according to claim 1, wherein a peak top molecular weight in gel permeation chromatography of a tetrahydrofuran soluble matter of the polyester resin (A) is 2000 to 20000.

15. The toner binder according to claim 1, wherein the polyester resin (A) has a glass transition temperature in a range from 30 to 75° C. and a softening point measured by a flow tester in a range from 120 to 170° C.

16. The toner binder according to claim 1, wherein a viscosity at the temperature of a glass transition point+40° C. of the polyester resin (A) indicated based upon Pa·s unit which is represented by Eta[Tg+40] satisfies the following formula (2):

$$Eta[Tg+40] \leq 7\times10^5 \qquad \text{Formula (2).}$$

17. The toner binder according to claim 1, wherein the polyester resin (P) further contains a liner polyester resin (B).

18. The toner binder according to claim 17, wherein a peak top molecular weight in gel permeation chromatography of a tetrahydrofuran soluble matter of the linear polyester resin (B) is in a range from 1000 to 10000.

19. The toner binder according to claim 17, wherein supposing that a total weight of the polyester resin (A) and the linear polyester resin (B) is 100, the linear polyester resin (B) has a content of 90% by weight or less.

20. A toner composition containing: the toner binder according to claim 1, a colorant, and if necessary, one or more additives selected from the group consisting of a release agent, a charge controlling agent, and a fluidizer.

* * * * *